US011422500B2

(12) United States Patent
Shinoya

(10) Patent No.: US 11,422,500 B2
(45) Date of Patent: Aug. 23, 2022

(54) IMAGE FORMING APPARATUS

(71) Applicant: BROTHER KOGYO KABUSHIKI KAISHA, Nagoya (JP)

(72) Inventor: Shota Shinoya, Nisshin (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/077,218

(22) Filed: Oct. 22, 2020

(65) Prior Publication Data

US 2021/0041826 A1 Feb. 11, 2021

Related U.S. Application Data

(63) Continuation of application No. 16/787,633, filed on Feb. 11, 2020, now Pat. No. 10,816,929.

(30) Foreign Application Priority Data

Feb. 22, 2019 (JP) ..... JP2019-030995

(51) Int. Cl.
*G03G 15/00* (2006.01)
*G03G 21/16* (2006.01)

(52) U.S. Cl.
CPC ..... *G03G 21/168* (2013.01); *G03G 21/1623* (2013.01); *G03G 2221/1684* (2013.01)

(58) Field of Classification Search
CPC ..... G03G 15/0863; G03G 21/1623; G03G 21/6652; G03G 21/168; G03G 21/1867; G03G 21/1875; G03G 2221/166; G03G 2221/1823
USPC ..... 399/107, 110–114, 124, 361, 381, 405
See application file for complete search history.

(56) References Cited

U.S. PATENT DOCUMENTS

| | | | | |
|---|---|---|---|---|
| 7,474,863 | B2 * | 1/2009 | Kaiga | G03G 21/1871 399/111 |
| 8,346,105 | B2 * | 1/2013 | Takahashi | G03G 21/1885 399/12 |
| 8,472,834 | B2 | 6/2013 | Satoh | |
| 9,304,483 | B2 * | 4/2016 | Komatsu | G03G 21/1875 |
| 9,563,169 | B1 * | 2/2017 | Carpenter | G03G 21/1817 |
| 9,606,498 | B2 | 3/2017 | Nishizawa et al. | |

(Continued)

FOREIGN PATENT DOCUMENTS

| | | |
|---|---|---|
| CN | 104090471 A | 10/2014 |
| JP | 2010-128336 A | 6/2010 |
| JP | 2019-28345 A | 2/2019 |

*Primary Examiner* — Hoan H Tran
(74) *Attorney, Agent, or Firm* — Merchant & Gould P.C.

(57) ABSTRACT

An image forming apparatus including a drawer and a main body. The drawer includes a frame holding a photosensitive drum rotatable about an axis extending in a first direction and a drawer-side connector including a drawer-side electrical contact part. The main body includes: a housing including a main body-side electrical contact part; a shaft extending in the first direction; a unit removably insertable to the housing; and a connection member. One end in a third direction intersecting with the first and second directions of the unit is fitted to the housing and the other end is supported to the shaft via the connection member. The main body-side connector is supported to the unit. The drawer-side electrical contact part and the main body-side electrical contact part are interconnected when the drawer is accommodated.

15 Claims, 23 Drawing Sheets

(56) References Cited

U.S. PATENT DOCUMENTS

| | | | |
|---|---|---|---|
| 10,025,225 | B2 | 7/2018 | Itabashi et al. |
| 2010/0135693 | A1 | 6/2010 | Okabe et al. |
| 2019/0041792 | A1 | 2/2019 | Kishi et al. |

* cited by examiner

※ L1 < L2

IMAGE FORMING APPARATUS

CROSS-REFERENCE TO RELATED APPLICATIONS

This application is a continuation of U.S. patent application Ser. No. 16/787,633, filed Feb. 11, 2020, now U.S. Pat. No. 10,816,929, which claims priority under 35 USC 119 from Japanese patent application No. 2019-030995 filed on Feb. 22, 2019. The entire contents of the aforementioned applications are incorporated herein by reference.

TECHNICAL FIELD

The present disclosure relates to an image forming apparatus.

BACKGROUND

There has been proposed an electrophotographic image forming apparatus such as a laser printer and an LED printer. The image forming apparatus includes a drawer. The drawer includes a plurality of photosensitive drums. A plurality of developing cartridges is removably insertable to the drawer. When the developing cartridges are inserted to the drawer, developing rollers of the developing cartridges and the photosensitive drums of the drawer are contacted to each other. The drawer having the developing cartridges inserted thereto is accommodated in a housing of an image forming apparatus main body.

SUMMARY

Illustrative aspects of the present disclosure provide an image forming apparatus capable of capable of improving positioning accuracy between an electrical contact part on a drawer-side and an electrical contact part on an image forming apparatus main body-side.

According to one illustrative aspect of the present disclosure, an image forming apparatus configured as described below is provided. That is, an image forming apparatus may comprise a drawer and an image forming apparatus main body. The drawer may comprise: a frame configured to hold a plurality of photosensitive drums while spacing the plurality of photosensitive drums at intervals in a second direction, each of the plurality of photosensitive drums being rotatable about an axis extending in a first direction; a drawer memory storing at least one of information about at least one of the plurality of photosensitive drums and information about developing cartridges removably insertable to the frame; and a drawer-side connector located at an outer surface of the frame on one side in the second direction, the drawer-side connector comprising a drawer-side electrical contact part electrically connected to the drawer memory. The image forming apparatus main body may comprise: a housing comprising: a pair of side frames facing each other in the first direction; and an internal space provided between the pair of side frames, the drawer being accommodated in the internal space by moving the drawer relative to the housing in the second direction; a controller; a main body-side connector electrically connectable to the controller, the main body-side connector comprising a main body-side electrical contact part contactable the drawer-side electrical contact part; a shaft extending in the first direction; a unit positioned between the pair of side frames, the unit being removably insertable to the housing at one end portion of the housing in the second direction; and a connection member configured to interconnect the unit and the shaft. One outer surface of the drawer in the second direction may be configured to press the shaft in a case the drawer is accommodated in the internal space. The unit may be fitted at one end in a third direction to the housing, the unit being supported at the other end in the third direction to the shaft via the connection member, the third direction intersecting with the first direction and the second direction, The main body-side connector may be supported to the unit. The drawer-side electrical contact part and the main body-side electrical contact part may be interconnected in the case the drawer is accommodated in the internal space.

According thereto, the image forming apparatus capable of capable of improving positioning accuracy between the electrical contact part on the drawer-side and the electrical contact part on the image forming apparatus main body-side may be provided.

BRIEF DESCRIPTION OF DRAWINGS

Illustrative embodiments of the disclosure will be described in detail based on the following figures, wherein.

DETAILED DESCRIPTION

There has been proposed a developing cartridge including a storage medium. In the storage medium, a variety of information about the developing cartridge is stored. Also, in the drawer, a variety of information about the photosensitive drum is handled. For this reason, the drawer is also required to mount a storage medium in which the variety of information about the photosensitive drum is stored. Not only in a case in which the storage medium having the information about the photosensitive drum stored therein is mounted to the drawer and but also in a case in which a storage medium having information about a developing cartridge stored therein is mounted to the drawer via the developing cartridge, the storage media are required to be electrically connected to an image forming apparatus main body-side controller.

However, when accommodating the drawer in the housing of the image forming apparatus main body, collision load is applied between the image forming apparatus main body and the drawer. Thereby, an error may occur in positional relation between the electrical contact part on the drawer-side, the electrical contact part on the image forming apparatus main body-side. In this case, the electrical contact part on the drawer-side and the electrical contact part on the image forming apparatus main body-side may not be smoothly connected.

Therefore, illustrative aspects of the present disclosure provide an image forming apparatus capable of capable of improving positioning accuracy between an electrical contact part on a drawer-side and an electrical contact part on an image forming apparatus main body-side.

Hereinbelow, an illustrative embodiment of the present disclosure will be described with reference to the accompanying drawings.

In descriptions below, a direction in which an axis of rotation center (drum axis) of a photosensitive drum extends is referred to as "first direction". Also, a direction in which a plurality of photosensitive drums is aligned is referred to as "second direction". The first direction and the second direction intersect with each other, and are preferably orthogonal to each other. Also, a direction intersecting with both the first direction and the second direction is referred to as "third direction". Also, a direction that intersects with both the first direction and the second direction and is different from the third direction is referred to as "fourth direction". The fourth direction is preferably a direction orthogonal to the first direction and including the second direction as a component. Also, a direction orthogonal to the first direction and the fourth direction is referred to as "fifth direction".

1. Configuration of Image Forming Apparatus

Figure 1:
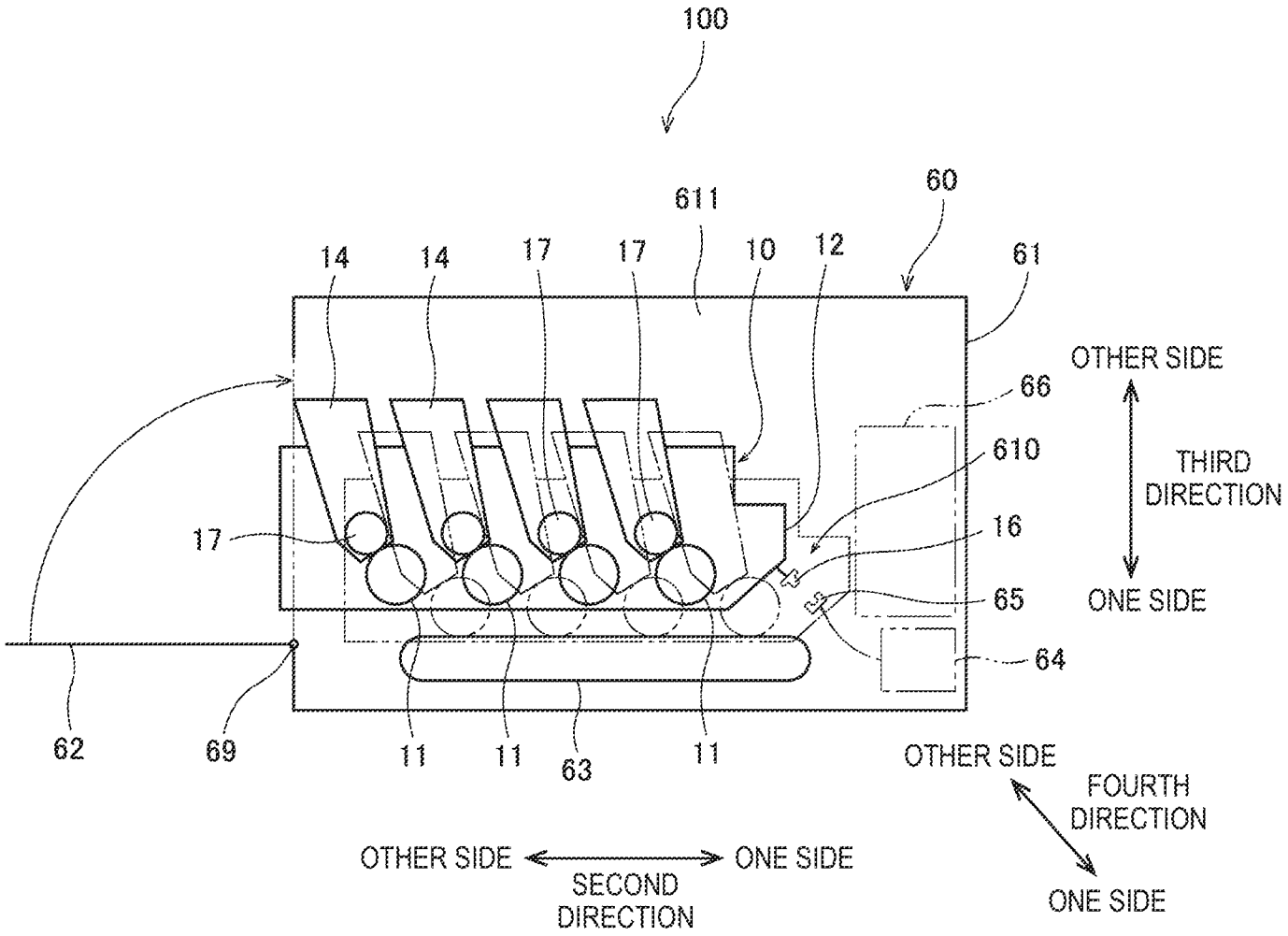
FIG. 1 is a schematic view of an image forming apparatus.
Figure 2:
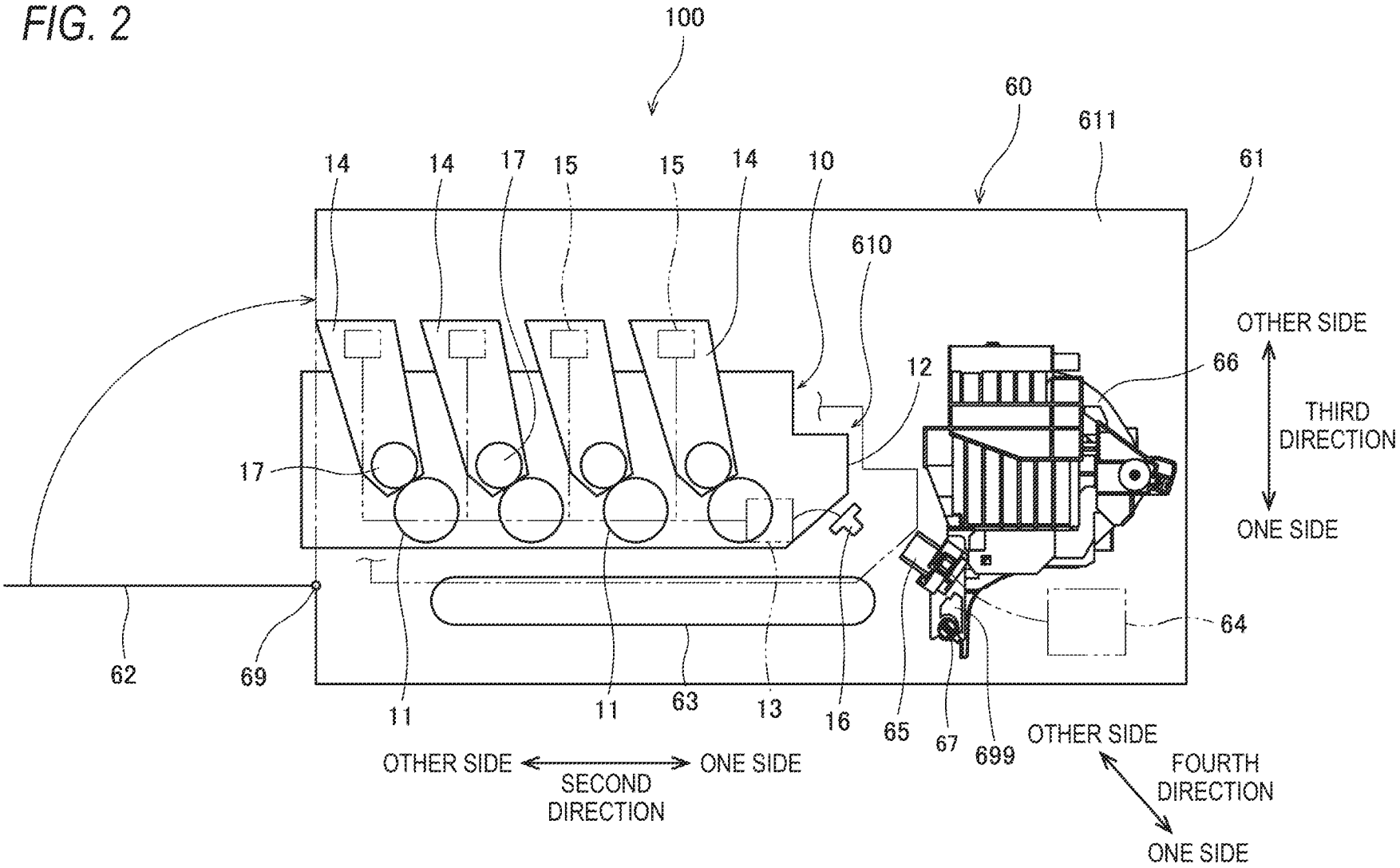
FIG. 2 is a schematic view of the image forming apparatus.

FIGS. 1 and 2 are schematic views of an image forming apparatus 100. The image forming apparatus 100 is an electrophotographic printer. As the image forming apparatus, a laser printer or an LED printer may be exemplified. As shown in FIGS. 1 and 2, the image forming apparatus 100 includes a drawer 10, and an image forming apparatus main body 60.

1-1. Configuration of Drawer

Figure 3:
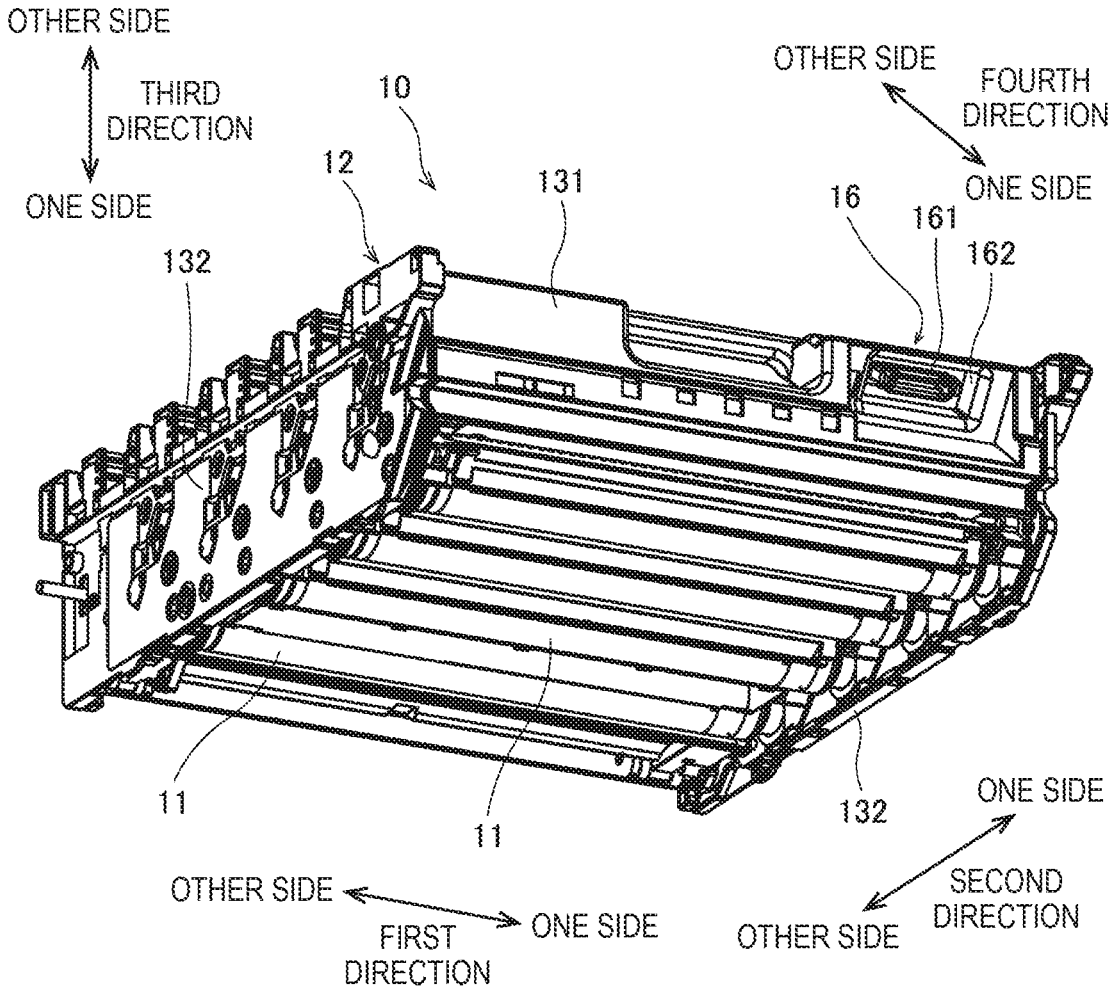
FIG. 3 is a perspective view of a drawer.
Figure 4:
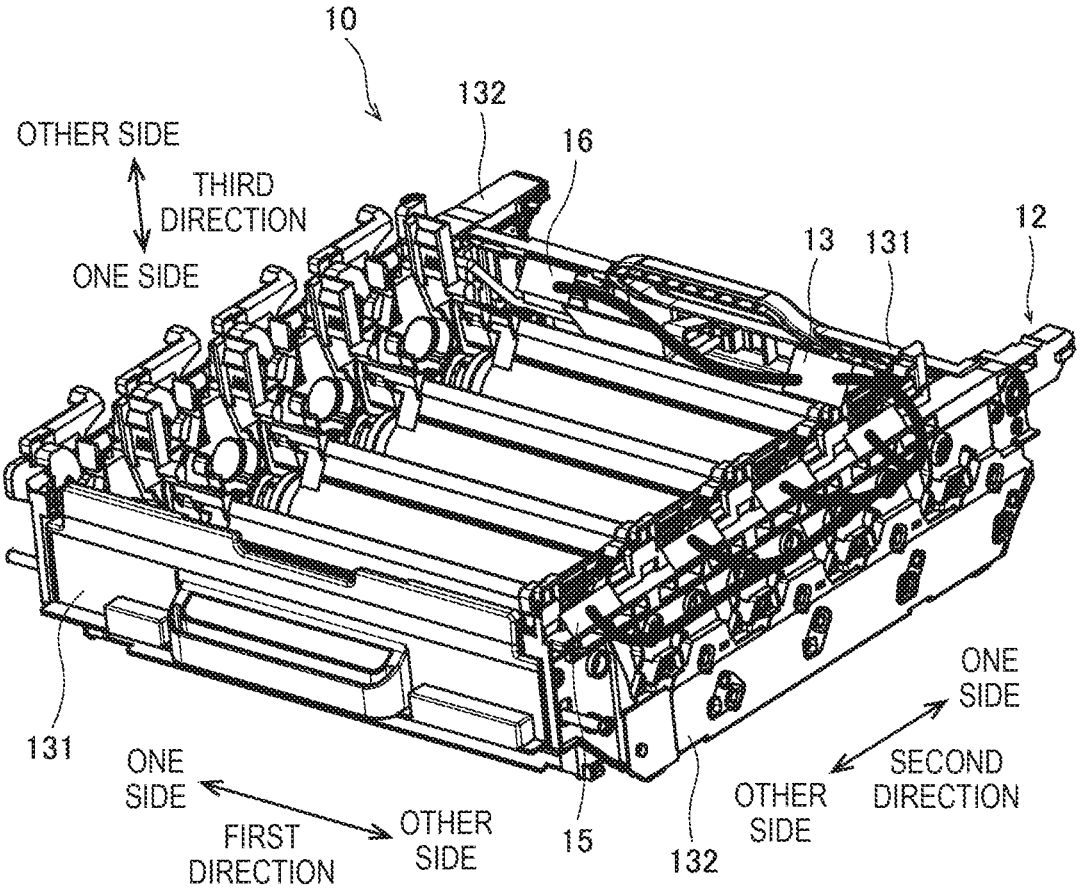
FIG. 4 is a perspective view of the drawer.

In the below, a configuration of the drawer 10 is described. FIGS. 3 and 4 are perspective views of the drawer 10. As shown in FIGS. 1 to 4, the drawer 10 includes four photosensitive drums 11, a frame 12, a drum memory (drawer memory) 13, four developing cartridges 14, four toner memories (drawer memory) 15, and a drawer-side connector 16.

As shown in FIGS. 3 and 4, each of the four photosensitive drums 11 has a cylindrical outer peripheral surface of which a center is a drum axis, which is an axis of rotation center extending in the first direction. The outer peripheral surface of the photosensitive drum 11 is covered with a photosensitive material. Also, each of the four photosensitive drums 11 is rotatable about the drum axis.

As shown in FIGS. 3 and 4, the frame 12 is a frame body configured to support the four photosensitive drums 11. The frame 12 is configured to hold the plurality of photosensitive drums 11 while spacing the same in the second direction. The frame 12 has a pair of the base plates 131 facing in the second direction, and a pair of side plates 132 facing in the first direction.

As shown in FIGS. 1 and 2, the developing cartridge 14 is removably insertable to the frame 12. The developing cartridge 14 has a housing in which toner, which is developing agent, can be accommodated. The four developing cartridges 14 accommodate therein toners of different colors (for example, cyan, magenta, yellow and black). Also, in the present illustrative embodiment, the developing cartridge 14 has a developing roller 17. The developing roller 17 is a cylindrical member. The developing roller 17 is rotatable about a developing axis, which is an axis of rotation center extending in the first direction. When the developing cartridge 14 is inserted to the frame 12, the outer peripheral surface of the photosensitive drum 11 is in contact with an outer peripheral surface of the developing roller 17.

The drum memory 13, the toner memory 15, and the drawer-side connector 16 will be described in detail later.

1-2. Configuration of Image Forming Apparatus Main Body

In the below, a configuration of the image forming apparatus main body 60 is described. As shown in FIGS. 1 and 2, the image forming apparatus main body 60 includes a housing 61, a cover 62, a transfer belt 63, a controller 64, and a main body-side connector 65.

The housing 61 has a substantial cuboid shape, and includes an internal space 610. The housing 61 has a pair of side frames 611 facing each other in the first direction. In the internal space 610 of the housing 61, the drawer 10 can be accommodated by moving the same relative to the housing 61 in an insertion direction. In the present illustrative embodiment, the "insertion direction" is a direction facing toward one side in the second direction. Like this, the drawer 10 having the developing cartridges 14 inserted thereto is accommodated in the housing 61. In addition, in the housing 61, four chargers (not shown), four light sources (not shown), the transfer belt 63, the controller 64, the main body-side connector 65, the sheet discharger 66, and the reference shaft (shaft) 67 are accommodated.

The cover 62 is movable between an open position shown with the solid line in FIG. 1 and a closed position shown with the dashed-two dotted line in FIG. 1. Specifically, the cover 62 is rotatable about a hinge 69 extending in the first direction. When the cover 62 is arranged in the open position, the internal space 610 of the housing 61 is opened. When the cover 62 is arranged in the closed position, the internal space 610 of the housing 61 is closed.

A user of the image forming apparatus 100 is movable the drawer 10 having the developing cartridges 14 inserted thereto in the insertion direction, in a state in which the cover 62 is located in the open position. Thereby, the drawer 10 is movable between a separation position in which at least a part thereof is located outside of the housing 61 and an installation position in which the drawer is set in the internal space 610.

The transfer belt 63 is an endless band-shaped belt for conveying a print sheet. The transfer belt 63 is positioned on an opposite side to the developing rollers 17 with the photosensitive drums 11 being interposed therebetween, in a state in which the drawer 10 is arranged in the installation position. An outer peripheral surface of the transfer belt 63 is contactable the outer peripheral surfaces of the photosensitive drums 11 in a state in which the drawer 10 is arranged in the installation position.

The sheet discharger 66 is a unit for guiding a print sheet having an image formed thereon to a sheet discharge tray (not shown) at an upper part of the housing 61. The sheet discharger 66 has a path for conveying the print sheet to the sheet discharge tray and a plurality of conveyor rollers arranged along the path. The sheet discharger 66 is provided downstream of the internal space 610 of the housing 61 with respect to the insertion direction. In other words, the sheet discharger 66 is provided along an inner surface of the housing 61 on one side in the second direction.

The controller 64 includes a processor such as a CPU, and a main body memory. The main body memory is a recording medium from and into which information can be read and written. The main body memory is, for example, a flash ROM or EEPROM. In the main body memory, a computer program for controlling operations of the image forming apparatus 100 is stored. The processor is configured to execute a variety of processing according to the computer program stored in the main body memory. That is, the processor is configured to execute printing processing of the image forming apparatus 100 and a variety of processing associated therewith.

The main body-side connector 65 and the reference shaft 67 will be described in detail later.

1-3. Configuration Relating to Electrical Connection

In the below, a configuration of electrical connection of the image forming apparatus 100 is described. Specifically, the drum memory 13, the toner memory 15, the drawer-side connector 16, and the main body-side connector 65 are described with reference to FIGS. 2 and 4.

1-3-1. Configuration Relating to Electrical Connection of Drawer

The drawer 10 has, as a configuration relating to electrical connection, the drum memory 13, the toner memory 15, and the drawer-side connector 16.

In the drum memory 13, information about at least one of the four photosensitive drums 11 is stored. Specifically, in the drum memory 13 of the present illustrative embodiment, drum identification information capable of identifying each photosensitive drum 11 and drum life-span information about life-span of the photosensitive drum 11 are stored. The drum identification information is, for example, a serial number. The drum life-span information is at least one of the number of rotations of the photosensitive drum 11 and the number of prints of the photosensitive drum 11. As shown in FIG. 4, the drum memory 13 of the present illustrative embodiment is positioned on an inner surface of the base plate 131, which is located at one side in the second direction, of the pair of the base plates 131. The drum memory 13 is configured to relay electrical connection between the toner memory 15 and the drawer-side connector 16, which will be described later.

The toner memory 15 is individually provided to each developing cartridge 14. In the toner memory 15, toner identification information capable of identifying each developing cartridge 14 and toner life-span information about life-span of the developing cartridge 14 are stored. The toner identification information is, for example, a serial number. The toner life-span information is at least one of the number of rotations of the developing roller 17, the number of prints of the developing roller 17, and the number of output dots. In a state in which the developing cartridge 14 is inserted to the drawer 10, the toner memory 15 of the present illustrative embodiment is positioned on an outer surface of the side plate 132, which is located on the other side in the first direction, of the pair of side plates 132.

As shown in FIG. 3, the drawer-side connector 16 is located on an outer surface of the base plate 131, which is located at one side in the second direction, of the pair of the base plates 131. The drawer-side connector 16 includes a drawer-side electrical contact part 161, and a socket 162. A plurality of electrical contact surfaces is aligned on the drawer-side electrical contact part 161. Any one of wirings such as a voltage line, a clock line, a data line and the like extends on each of the electrical contact surfaces, and the wirings are connected to the drum memory 13. Also, the wirings are electrically connected to the corresponding toner memories 15 via the drum memory 13. The wirings are appropriately bundled to form a harness. In this way, the drawer-side electrical contact part 161 is electrically connected to the drum memory 13 and the toner memories 15.

When the drawer-side connector 16 is connected to the main body-side connector 65, which will be described later, the drum memory 13 and toner memories 15, and the controller 64 are electrically connected. Thereby, the controller 64 can perform communication with the drum memory 13 and the toner memories 15.

The socket 162 shown in FIG. 3 extends in the fourth direction. The socket 162 is configured to hold therein the drawer-side electrical contact part 161. That is, the socket 162 is configured to surround the drawer-side electrical contact part 161. The socket 162 has such a shape that it gradually converges toward the drawer-side electrical contact part 161 in the fourth direction. In other words, the socket 162 becomes wider apart from the drawer-side electrical contact part 161, toward one side in the fourth direction.

Figure 5:
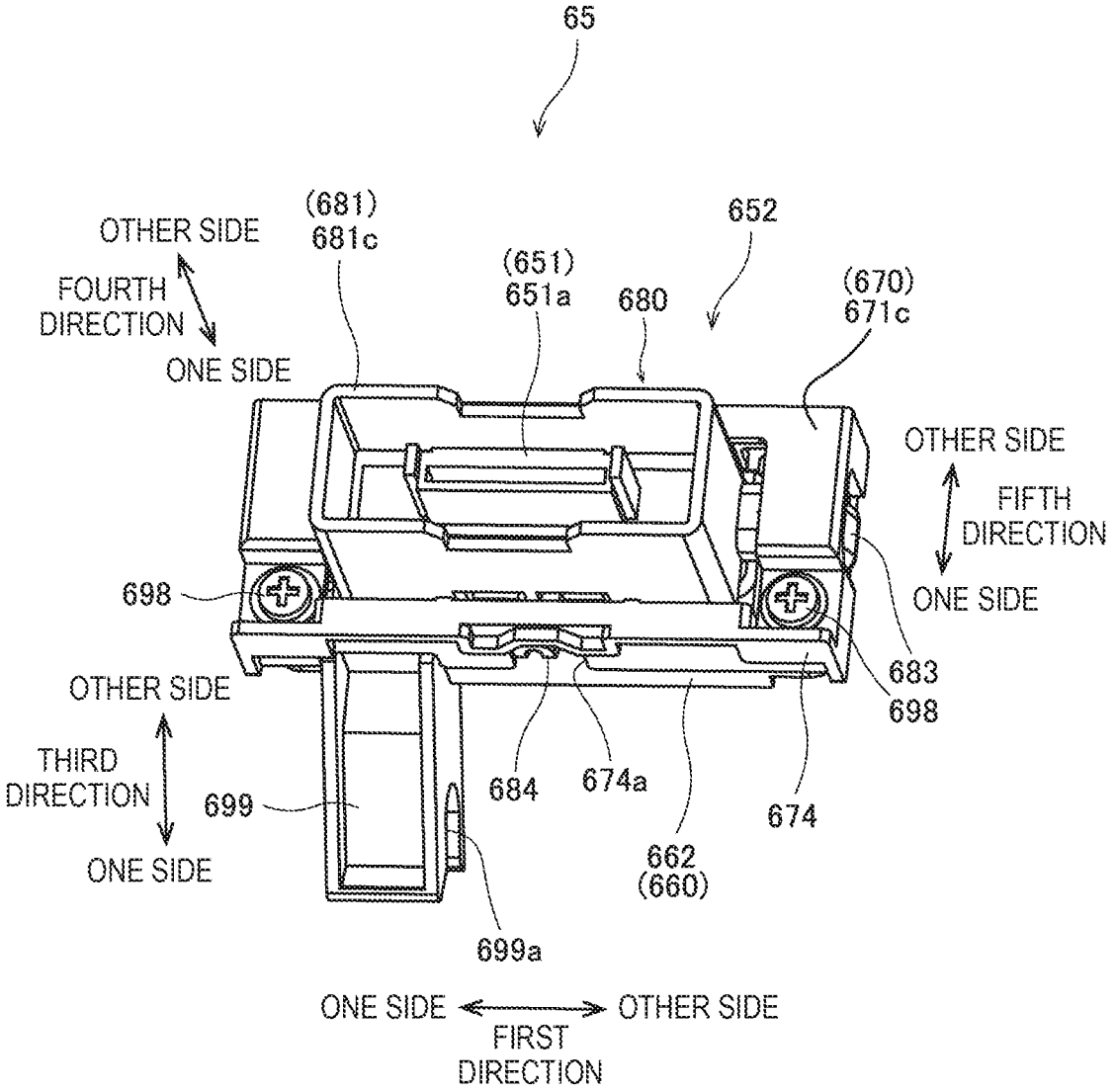
FIG. 5 is a perspective view of a main body-side connector.

1-3-2. Configuration Relating to Electrical Connection of Image Forming Apparatus Main Body FIG. 5 is a perspective view of the main body-side connector 65. As shown in FIG. 5, the main body-side connector 65 includes a main body-side electrical contact part 651, and a holder 652. A plurality of electric contact points is aligned at the main body-side electrical contact part 651. From each of the electric contact points, any one of wirings such as a voltage line, a clock line, a data line and the like extends. The wirings are connected to corresponding terminals of the controller 64. The wirings are appropriately bundled to form a harness. In this way, the main body-side electrical contact part 651 is electrically connected to the controller 64.

When the drawer 10 is inserted into the internal space 610 of the housing 61 and is thus arranged in the installation position, the main body-side connector 65 and the drawer-side connector 16 are interconnected. Thereby, each electrical contact surface of the drawer-side electrical contact part 161 is contacted to the corresponding electric contact point of the main body-side electrical contact part 651.

The holder 652 is configured to hold the main body-side electrical contact part 651 so as to be movable, i.e., floatable in the fourth direction and in a direction orthogonal to the fourth direction. The direction intersecting with the fourth direction is the fifth direction, for example. The specific configuration of the holder 652 will be described later.

In the image forming apparatus 100 configured as described above, upon execution of printing processing, the controller 64 is configured to drive a motor (not shown). The photosensitive drums 11 and the developing rollers 17 are configured to rotate by drive of the motor. Also, the controller 64 is configured to electrically charge surfaces of the photosensitive drums 11 by feeding power to the chargers. Also, the controller 64 is configured to cause the light sources to emit lights, thereby irradiating the lights from the light sources toward the outer peripheral surfaces of the photosensitive drums 11. Thereby, electrostatic latent images of an image to be printed are formed on the outer peripheral surfaces of the photosensitive drums 11. The toners of the developing cartridges 14 are supplied onto the electrostatic latent images on the photosensitive drums 11 via the developing rollers 17. Thereby, toner images are formed on the outer peripheral surfaces of the photosensitive drums 11. Thereafter, the print sheet is conveyed between the photosensitive drums 11 and the transfer belt 63. Thereby, the toner images are transferred from the outer peripheral surfaces of the photosensitive drums 11 to the print sheet. In the state in which the toner images have been transferred to the print sheet, the print sheet is conveyed to a fixing device in the image forming apparatus 100. Thereby, the toner images transferred to the print sheet are heat-fixed on the print sheet. As a result, an image is printed on the print sheet.

In the meantime, upon execution of the printing processing, the controller 64 is configured to perform communication with the drum memory 13 and the toner memories 15, thereby acquiring the information about the life-span of the photosensitive drums 11 and the life-span of the developing cartridges 14, for example. Thereby, the controller 64 can set a favorable mode to execute the printing processing or stop the printing processing, depending on situations.

1-4. Detailed Configurations of Respective Units of Main Body-Side Connector In the below, a configuration of the main body-side connector 65, particularly, a detailed description of the holder 652 is described with reference to FIGS. 5 to 18. As shown in FIG. 5, the holder 652 includes a base 660, a cover 670, a panel 680, and coil springs 690 (refer to FIG. 6).

1-4-1. Configuration of Base

Figure 6:
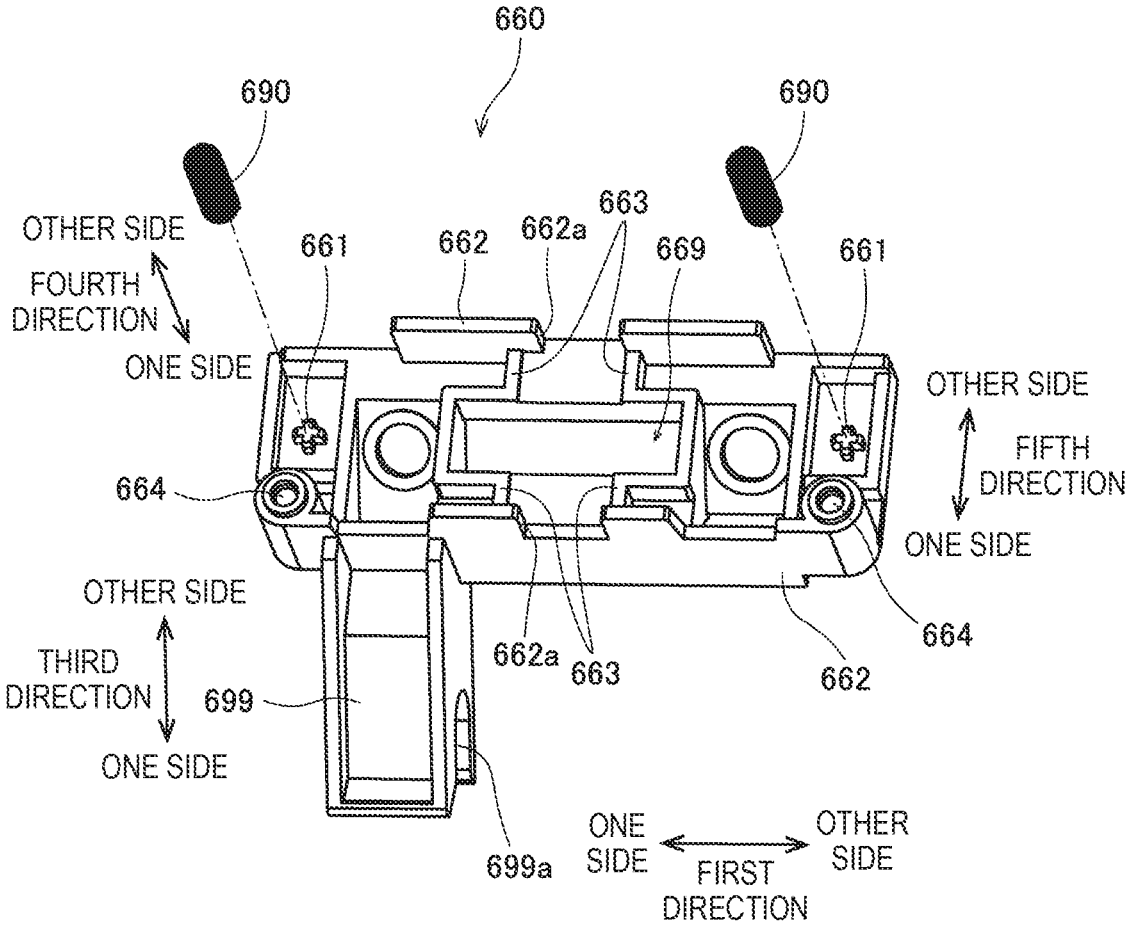
FIG. 6 is a perspective view of a base.
Figure 7:
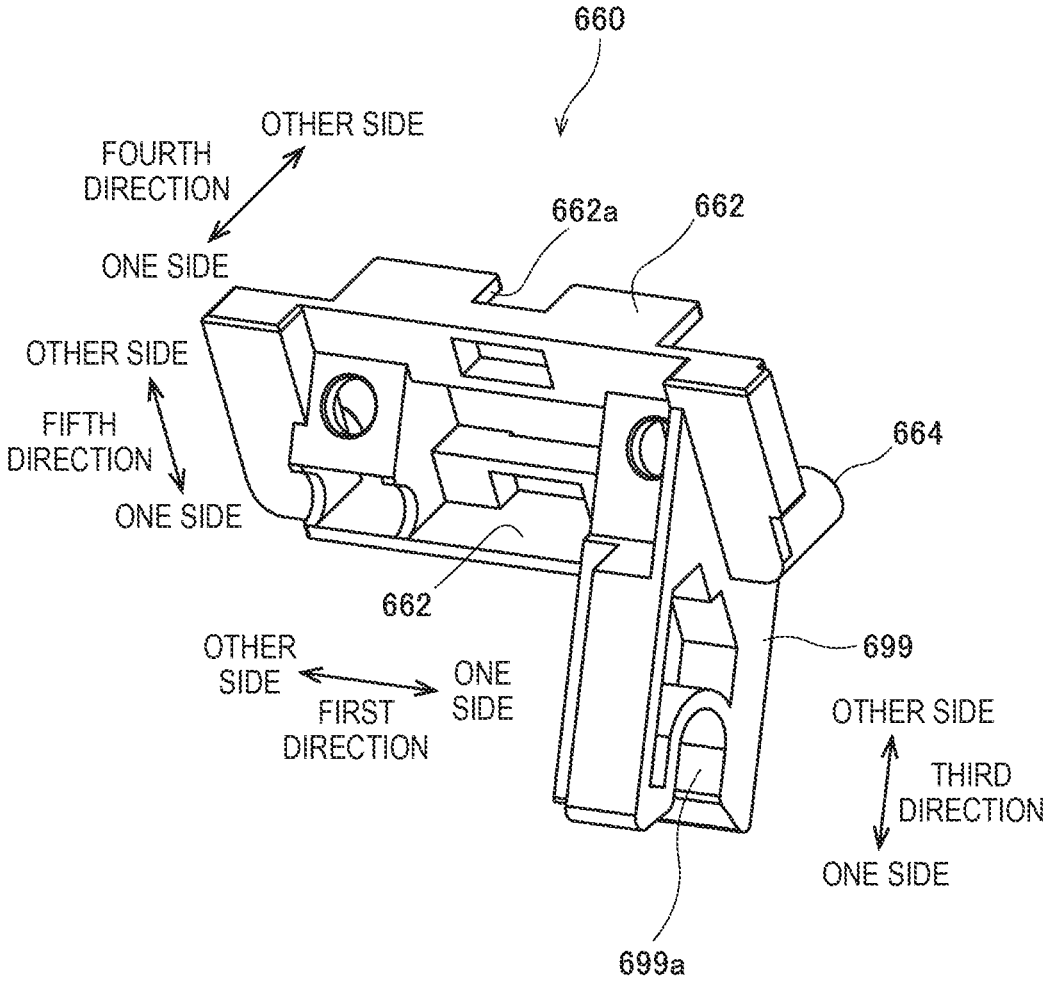
FIG. 7 is a perspective view of the base.

First, a configuration of the base 660 is described with reference to FIGS. 6 and 7. FIG. 6 is a perspective view of the base 660 and the coil springs 690. FIG. 7 is a perspective view of the base 660, as seen in a direction different from FIG. 6.

The base 660 has a rectangular shape, as seen in the fourth direction. The base 660 has an attachment part 699. As described in detail later, the attachment part 699 is used to attach the base 660 to the reference shaft 67 extending in the first direction in the internal space 610 of the housing 61. The base 660 has a through-hole 669 penetrating a central portion of the rectangular shape in the fourth direction. An inner peripheral surface of the through-hole 669 has a rectangular shape having long sides and short sides, as seen in the fourth direction.

The base 660 has first spring seats 661 on an outer surface on the other side in the fourth direction. One end of the coil spring 690 (which will be described later) in the fourth direction is connected to the first spring seat 661. The first spring seats 661 are arranged at two places, i.e., one side of the through-hole 669 in the first direction and the other side of the through-hole 669 in the first direction with the through-hole 669 being interposed therebetween.

The base 660 has a pair of end walls 662 facing each other in the fifth direction. Each end wall 662 extends perpendicularly to the fifth direction. A central portion of the end wall 662 in the first direction is provided with a rectangular notch 662*a* opening toward the other side in the fourth direction.

Also, the base 660 has a first contact surface 663 protruding in a rib shape on the outer surface on the other side in the fourth direction. The first contact surface 663 is a flat surface-shaped part perpendicular to the fourth direction. The first contact surface 663 extends in the fifth direction from parts of the long sides of the through-hole 669. The first contact surface 663 more protrudes toward the other side in the fourth direction than a region adjacent in the first direction.

Also, the base 660 has opened screw holes 664 on the outer surface on the other side in the fourth direction. The screw hole 664 extends toward one side in the fourth direction. The screw hole 664 has a female screw on an inner peripheral surface thereof.

1-4-2. Configuration of Cover

Figure 8:
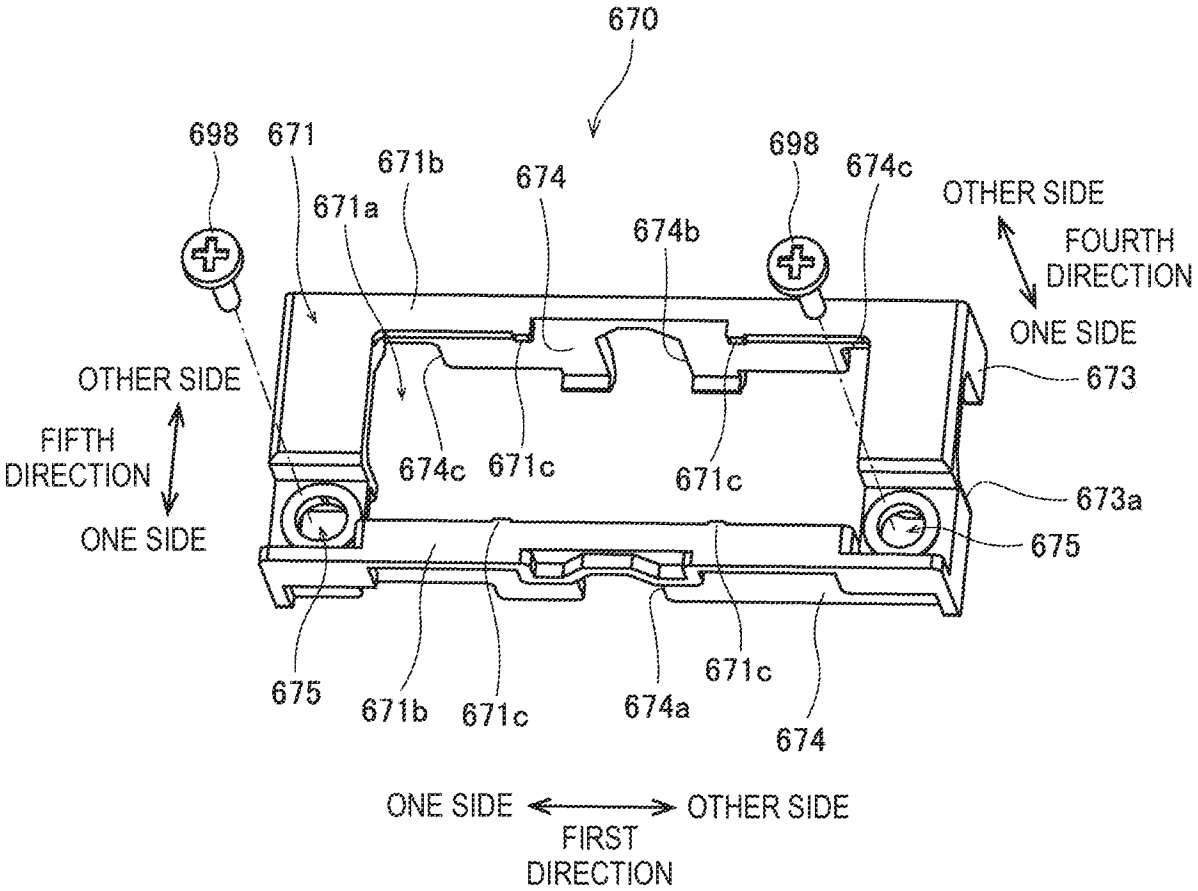
FIG. 8 is a perspective view of a cover.
Figure 9:
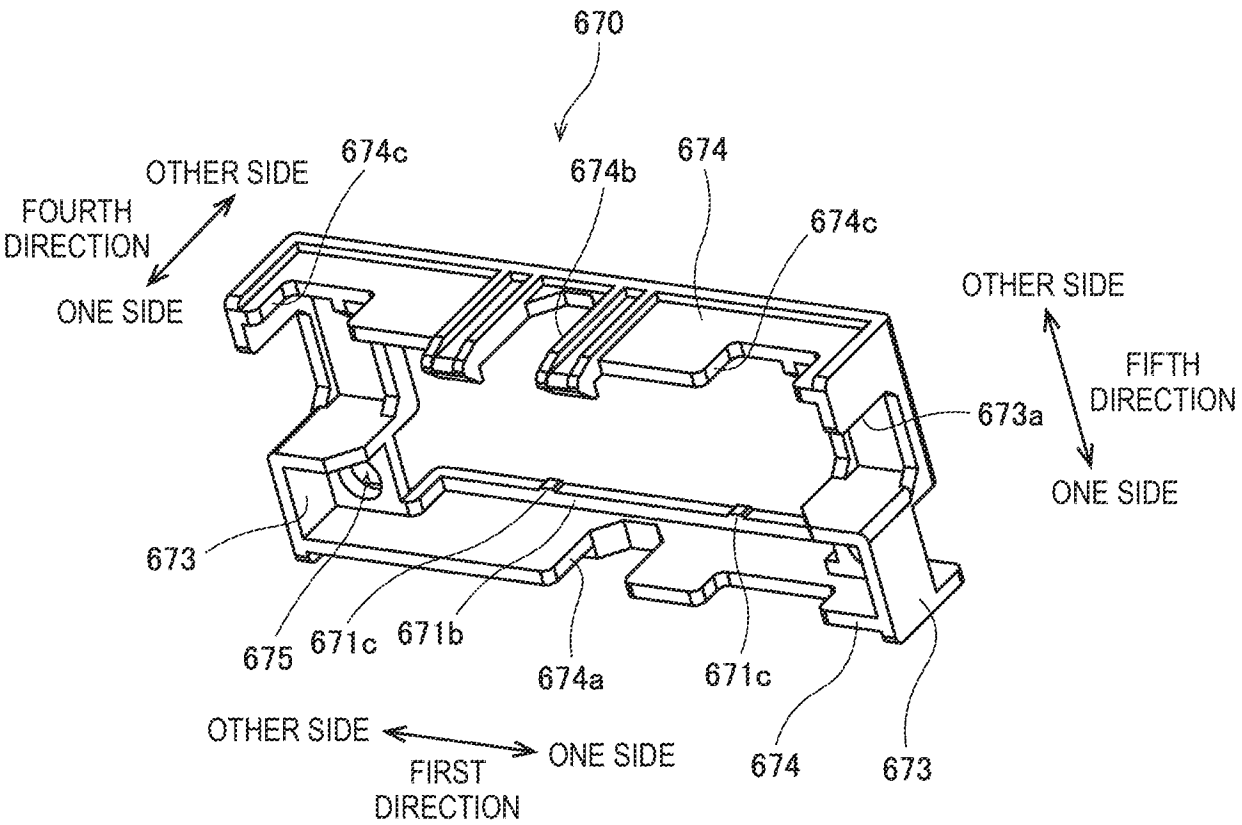
FIG. 9 is a perspective view of the cover.

Subsequently, a configuration of the cover 670 is described with reference to FIGS. 8 and 9. FIG. 8 is a perspective view of the cover 670 and screws 698. FIG. 9 is a perspective view of the cover 670, as seen in a direction different from FIG. 8.

The cover 670 has a rectangular frame shape, as seen in the fourth direction. The cover 670 has a frame part 671, a pair of first sidewalls 673, and a pair of second sidewalls 674. The frame part 671 has a rectangular outer shape, and is formed at its central part with a through-hole 671*a*. An inner peripheral surface of the through-hole 671*a* has a rectangular shape having long sides and short sides conforming to the outer shape of the frame part 671.

The pair of first sidewalls 673 is spaced in the first direction. The first sidewall 673 has a plate shape perpendicular to the first direction. The first sidewall 673 extends from a short side part of an outer edge of the frame part 671 toward one side in the fourth direction. The pair of second sidewalls 674 is spaced in the fifth direction. The second sidewall 674 has a plate shape perpendicular to the fifth direction. The second sidewall 674 extends from a long side part of the outer edge of the frame part 671 toward one side in the fourth direction.

The frame part 671 has a pair of through-holes 675. The through-hole 675 is formed to penetrate the frame part 671 in the fourth direction. As described later, the cover 670 is fixed to the base 660 with being overlapped in the fourth direction. The through-holes 675 are provided in positions corresponding to the screw holes 664 of the base 660. In the through-hole 675, a shaft part of the screw 698 can be inserted. When the frame part 671 is seen from the other side in the fourth direction, a region in which the through-hole 675 of the frame part 671 is formed is more recessed than the other region toward one side in the fourth direction.

A second sidewall 674, which is located at one side in the fifth direction, of the pair of second sidewalls 674 has a first notch 674*a* opening toward one side in the fourth direction. The first notch 674*a* is provided at a central portion in the first direction of the second sidewall 674 located at one side in the fifth direction. A width of the first notch 674*a* in the first direction gradually decreases toward the other side in the fourth direction. That is, the width of the first notch 674*a* in the first direction decreases away from the base 660 in the fourth direction.

In the present illustrative embodiment, a second sidewall 674, which is located at the other side in the fifth direction, of the pair of second sidewalls 674 has a notch 674*b* opening toward one side in the fourth direction. When seen in the fifth direction, the notch 674*b* is provided with being overlapped with the first notch 674*a*. Also, the second sidewall 674 has second notches 674*c* provided in positions at both sides in the first direction away from a position (a position of the notch 674*b*) facing the first notch 674*a*. When seen in the fifth direction, the second notches 674*c* are provided in a pair with the notch 674*b* being interposed therebetween. The second notch 674*c* opens toward one side in the fourth direction. The second notch 674*c* has a rectangular shape, as seen in the fifth direction.

When seen in the fourth direction, the first notch 674*a* and the pair of second notches 674*c* are respectively arranged at apexes of a virtual isosceles triangle.

The first sidewalls 673 have third notches 673*a* opening toward one side in the fourth direction. The third notches 673*a* are provided in a pair on the first sidewalls 673 facing each other. The third notch 673*a* has a rectangular shape, as seen in the first direction.

Specifically, the frame part 671 of the cover 670 includes a flat surface 671*b*, and protrusions 671*c*. The flat surface 671*b* has a rectangular shape extending from end portions of the second sidewalls 674 at an opposite side (other side) to the base 660 in the fourth direction toward an inside of the cover 670 in the fifth direction. The protrusions 671*c* partially protrude from an inner edge of the flat surface 671*b* toward the inside of the cover 670 in the fifth direction. When seen in the fourth direction, the protrusions 671*c* are provided at four places on both sides in the first direction with the notches 674*a* and 674*b* being interposed therebetween. The four the protrusions 671*c* are respectively arranged at apexes of a virtual rectangle, as seen in the fourth direction.

1-4-3. Configuration of Panel

Figure 10:
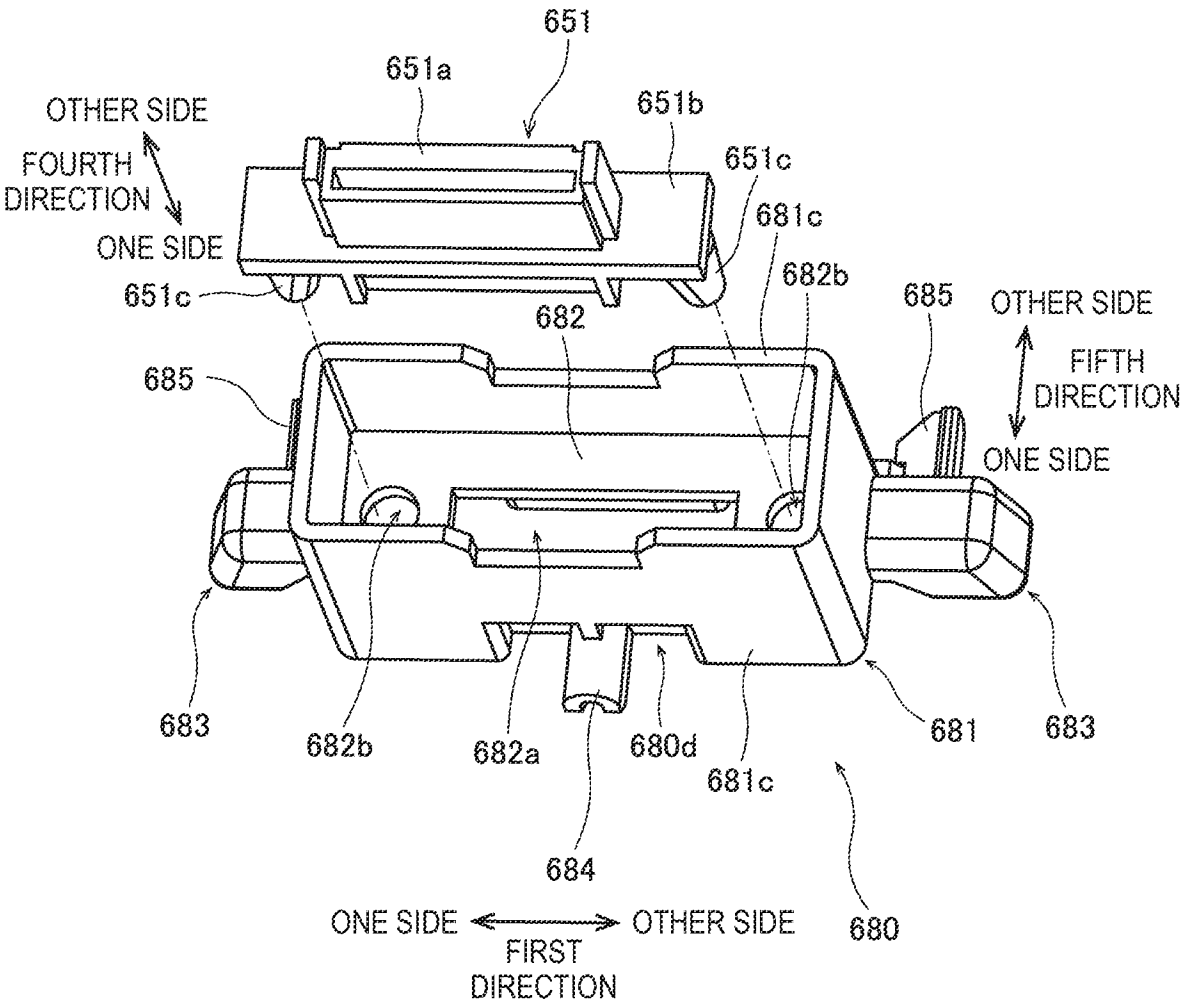
FIG. 10 is an exploded perspective view of a panel and a main body-side electrical contact part.
Figure 11:
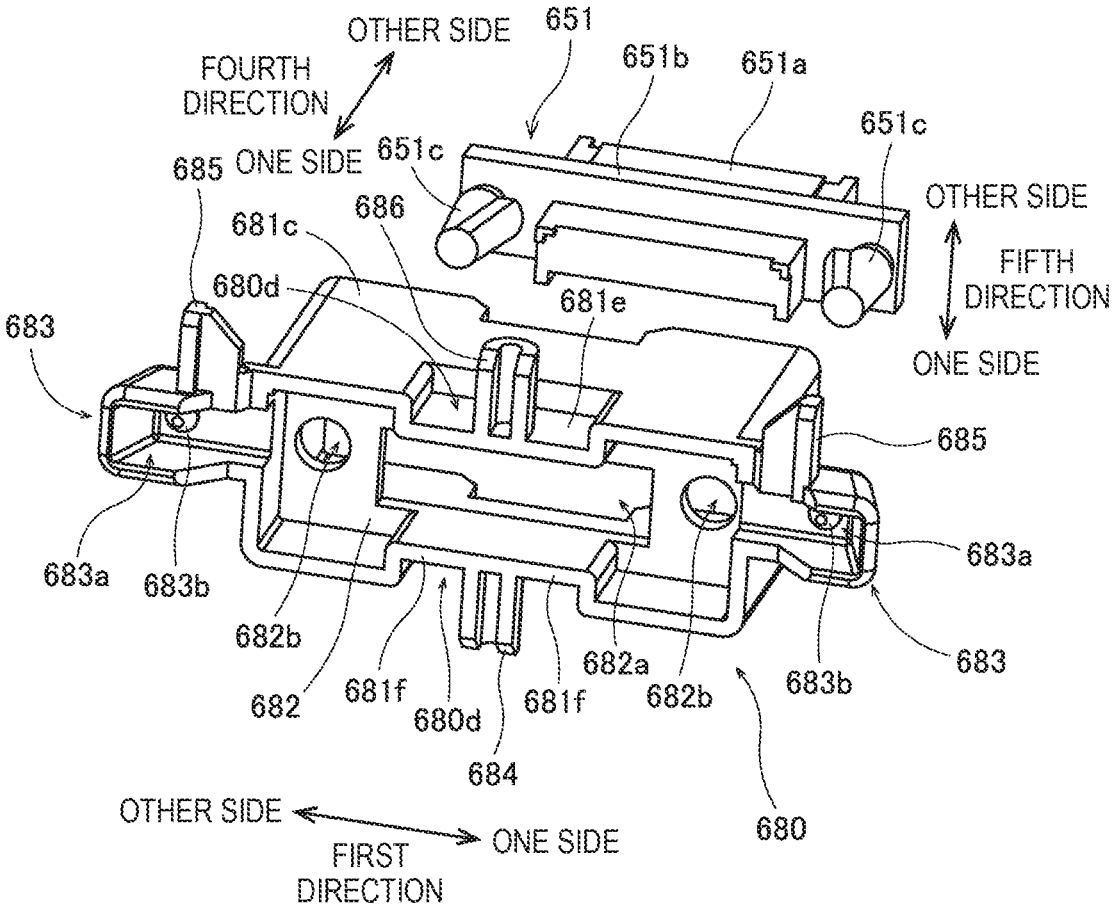
FIG. 11 is an exploded perspective view of the panel and the main body-side electrical contact part.

Subsequently, a configuration of the panel 680 is described with reference to FIGS. 10 and 11. FIG. 10 is a perspective view of the panel 680 and the main body-side electrical contact part 651. FIG. 11 is a perspective view of the panel 680 and the main body-side electrical contact part 651, as seen in a direction different from FIG. 10.

The panel 680 includes a box body 681, and a partitioning plate 682. The box body 681 has a square tube shape, and extends in the fourth direction. The box body 681 has a substantially rectangular outer shape, as seen in the fourth direction. The partitioning plate 682 has a rectangular plate shape perpendicular to the fourth direction. The partitioning plate 682 extends from an inner surface of a part of the box body 681 in the fourth direction toward an inside of the box body 681. The partitioning plate 682 is formed at a central part with a rectangular through-hole 682*a* conforming to the outer shape of the partitioning plate 682.

Through-holes (attachment part) 682*b* are arranged at both sides of the partitioning plate 682 in the first direction with the through-hole 682*a* being interposed therebetween. An inner peripheral surface of the through-hole 682*b* has a circular shape, as seen in the fourth direction. The main body-side electrical contact part 651 is attached into the through-holes 682*b* from the other side in the fourth direction.

The panel 680 has a pair of ear parts 683 extending outside of the panel 680 from both sides of the box body 681 in the first direction. The ear parts 683 are arranged at both sides in the first direction with the through-hole 682*a* and the through-holes 682*b* being interposed therebetween.

As shown in FIG. 11, the ear part 683 has therein a void. In other words, the ear part 683 has a concave portion 683*a* opening toward the base 660. The ear part 683 has a second spring seat 683*b* at a bottom of the concave portion 683*a*. That is, the second spring seat 683*b* is provided inside of the concave portion 683*a*. The spring seat 683*b* is connected with the other end of the coil spring 690 in the fourth direction.

End portions, which are located at one side in the fourth direction, of a pair of sidewalls 681*c*, which are perpendicular to the fifth direction, of sidewalls of the box body 681 have a concave portion 680*d*, respectively. The concave portion 680*d* is recessed from the sidewall 681*c* toward a radially inward side of the box body 681. A bottom of the concave portion 680*d* is configured as a flat surface portion 681*e* perpendicular to the fifth direction. An end face of the flat surface portion 681*e* on one side in the fourth direction continues to an end face of the box body 681 on one side in the fourth direction. The end face of the flat surface portion 681*e* at one side in the fourth direction is configured as a second contact surface 681*f* As described later, the second contact surface 681*f* is contactable the first contact surface 663 of the base 660.

Also, the box body 681 has a first protrusion 684, a pair of second protrusions 685, and a third protrusion 686. The first protrusion 684 extends from the concave portion 680*d*, which is located at one side in the fifth direction, of the pair of concave portions 680*d* toward an outside of the box body 681. That is, the first protrusion 684 extends toward one side in the fifth direction. The second protrusions 685 extend from the pair of ear parts 683 toward the other side in the fifth direction, respectively. Also, the third protrusion 686 extends from the concave portion 680*d*, which is located at the other side in the fifth direction, of the pair of concave portions 680*d* toward an outside of the box body 681. That is, the third protrusion 686 extends toward the other side in the fifth direction.

The first protrusion 684 and the third protrusion 686 have a semicircular section, when taken along a section perpendicular to the fifth direction, respectively. The semicircular section has an open end directed to one side in the fourth direction. That is, outer surfaces of the first protrusion 684 and the third protrusion 686 have a semicircular shape of which a width in the first direction gradually decreases toward the other side in the fourth direction, as seen in the fifth direction.

1-4-4. Configuration of Coil Spring

The coil spring 690 is an elastic member of which a metal line is wound in a spiral shape. The coil spring 690 is extendable and contractable in the fourth direction. Also, the coil spring 690 is bendable in a radial direction of the spiral. As described later, the coil spring 690 is arranged between the first spring seat 661 of the base 660 and the second spring seat 683*b* of the ear part 683 of the panel 680 in a state in which it is compressed more than a natural length.

1-5. Configuration of Main Body-Side Electrical Contact Part

In the below, a configuration of the main body-side electrical contact part 651 is described with reference to FIGS. 10 and 11. The main body-side electrical contact part 651 has a female connector terminal 651*a*, a connector terminal support 651*b*, and a pair of shaft parts 651*c*.

The female connector terminal 651*a* is arranged therein with the plurality of electric contact points. The connector terminal support 651*b* is a rectangular plate-shaped part perpendicular to the fourth direction. The female connector terminal 651*a* is fixed to a central part of the connector terminal support 651*b*. The pair of shaft parts 651*c* is positioned on an end face of the connector terminal support 651*b* on one side in the fourth direction. The shaft parts 651*c* are arranged at both sides in the first direction with the female connector terminal 651*a* being interposed therebetween.

The shaft part 651*c* has a conical shape, and protrudes from the connector terminal support 651*b* toward one side in the fourth direction. The shaft part 651*c* is formed of an elastic material. The shaft part 651*c* can be contracted radially as a result of operator's pressing.

Figure 12:
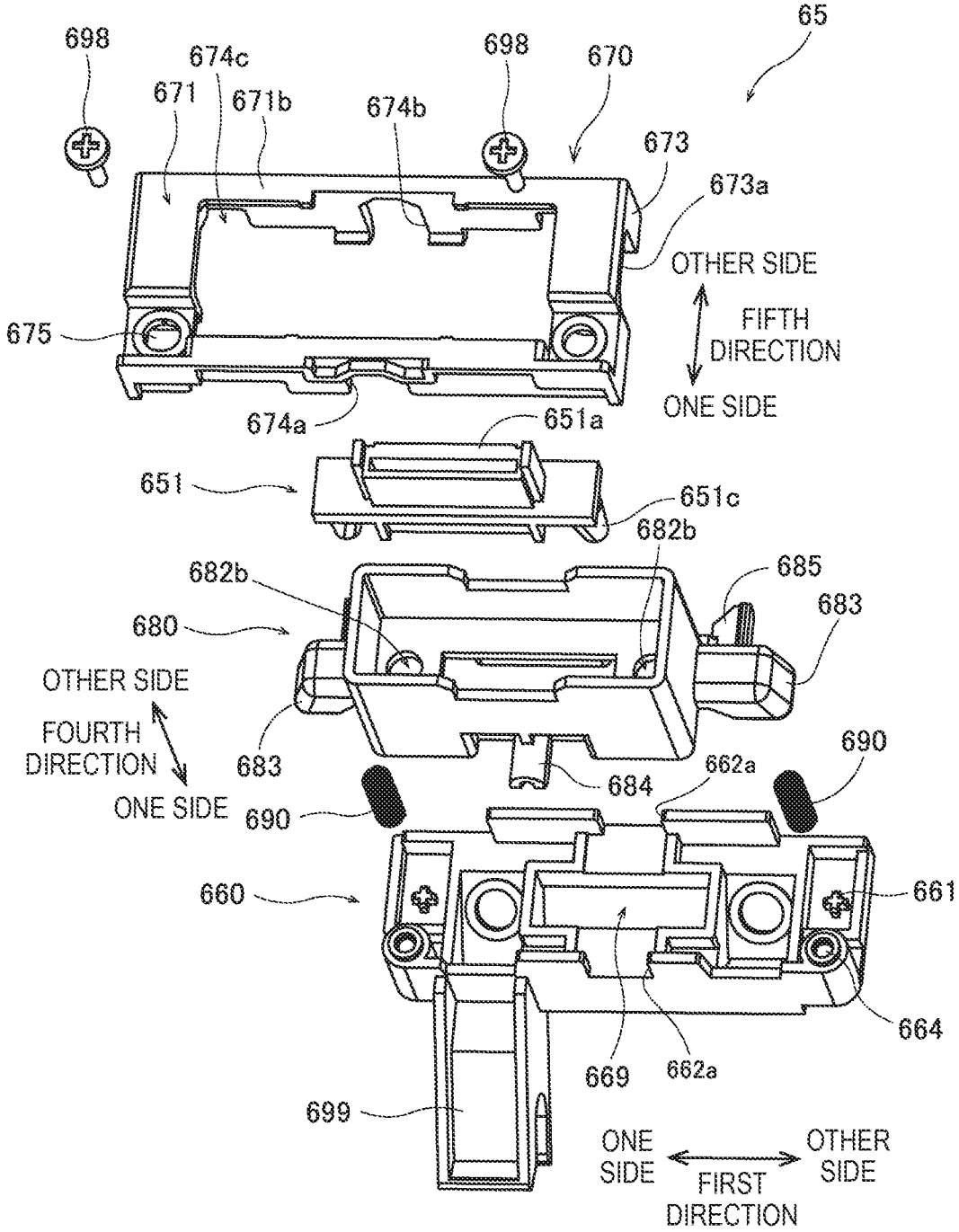
FIG. 12 is an exploded perspective view of the main body-side connector.
Figure 13:
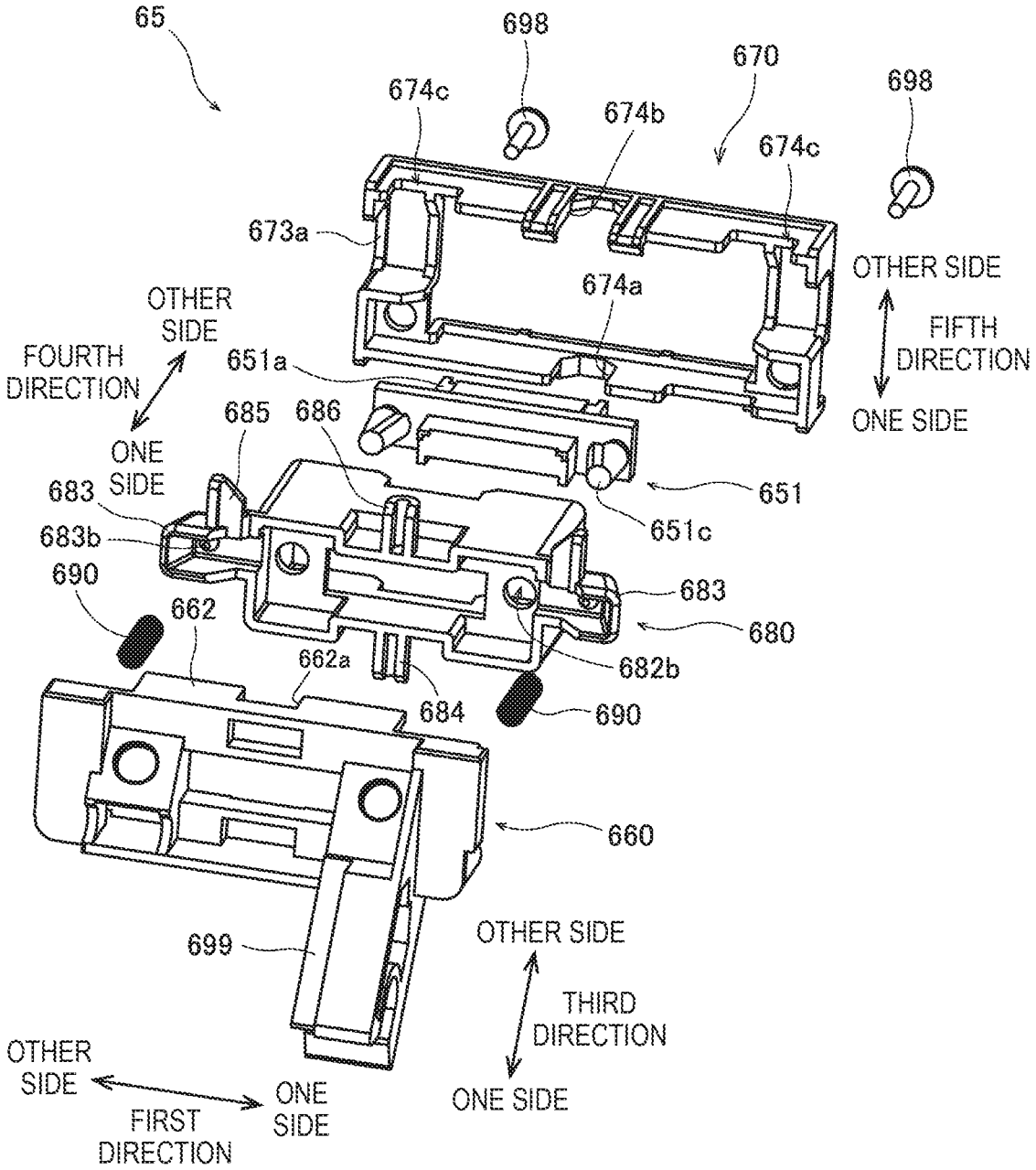
FIG. 13 is an exploded perspective view of the main body-side connector.

1-6. Attachment Configuration of Respective Parts of Main Body-Side Connector In the below, an attachment aspect of the base 660, the cover 670, the panel 680, the coil springs 690, the screws 698, and the main body-side electrical contact part 651 is described with reference to FIGS. 12 and 13. FIG. 12 is an exploded perspective view of the main body-side connector 65. FIG. 13 is an exploded perspective view of the main body-side connector 65, as seen in a direction different from FIG. 12.

First, an operator in a factory for manufacturing the image forming apparatus 100 inserts the shaft parts 651*c* of the main body-side electrical contact part 651 into the through-holes 682*b* of the partitioning plate 682 of the panel 680 while pressing the shaft parts 651*c*. Thereby, the main body-side electrical contact part 651 is attached to the panel 680. The shaft parts 651*c* expand radially outward after passing through the through-holes 682*b*. Thereby, the main body-side electrical contact part 651 cannot be separated from the partitioning plate 682 of the panel 680.

The panel 680 having the main body-side electrical contact part 651 attached thereto is partially sandwiched between the base 660 and the cover 670. Specifically, one ends of the pair of coil springs 690 are respectively attached to the first spring seats 661 of the base 660. In this state, the panel 680 is overlapped over the base 660 from the other side in the fourth direction. At this time, the other ends of the coil springs 690 are attached to the second spring seats 683*b* of the ear parts 683 of the panel 680. Also, the first protrusion 684 of the panel 680 is accommodated in the notch 662*a* of the base 660 on one side in the fifth direction. Also, the pair of second protrusions 685 of the panel 680 is arranged on both sides of the end wall 662 in the first direction while sandwiching the end wall 662 on the other side in the fifth direction therebetween. The third protrusion 686 of the panel 680 is accommodated in the notch 662*a* of the base 660 on the other side in the fifth direction.

As shown in FIGS. 12 and 13, the cover 670 is further overlapped over the base 660 having the panel 680 overlapped thereon, from the other side in the fourth direction. At this time, the first protrusion 684 of the panel 680 is accommodated in the first notch 674*a* of the cover 670. The pair of second protrusions 685 of the panel 680 is accommodated in the second notches 674*c* of the cover 670. The third protrusion 686 of the panel 680 is accommodated in the notch 674*b* of the cover 670. The pair of ear parts 683 of the panel 680 is accommodated in the pair of third notches 673*a* of the cover 670. In this state, the shaft parts of the screws 698 are inserted into the through-holes 675 of the cover 670 from the other side in the fourth direction, and are screwed into the screw holes 664 of the base 660. Thereby, the cover 670 is fixed to the base 660 while sandwiching the coil springs 690 and the panel 680 therebetween.

1-7. Movement of Connector

Figure 14:
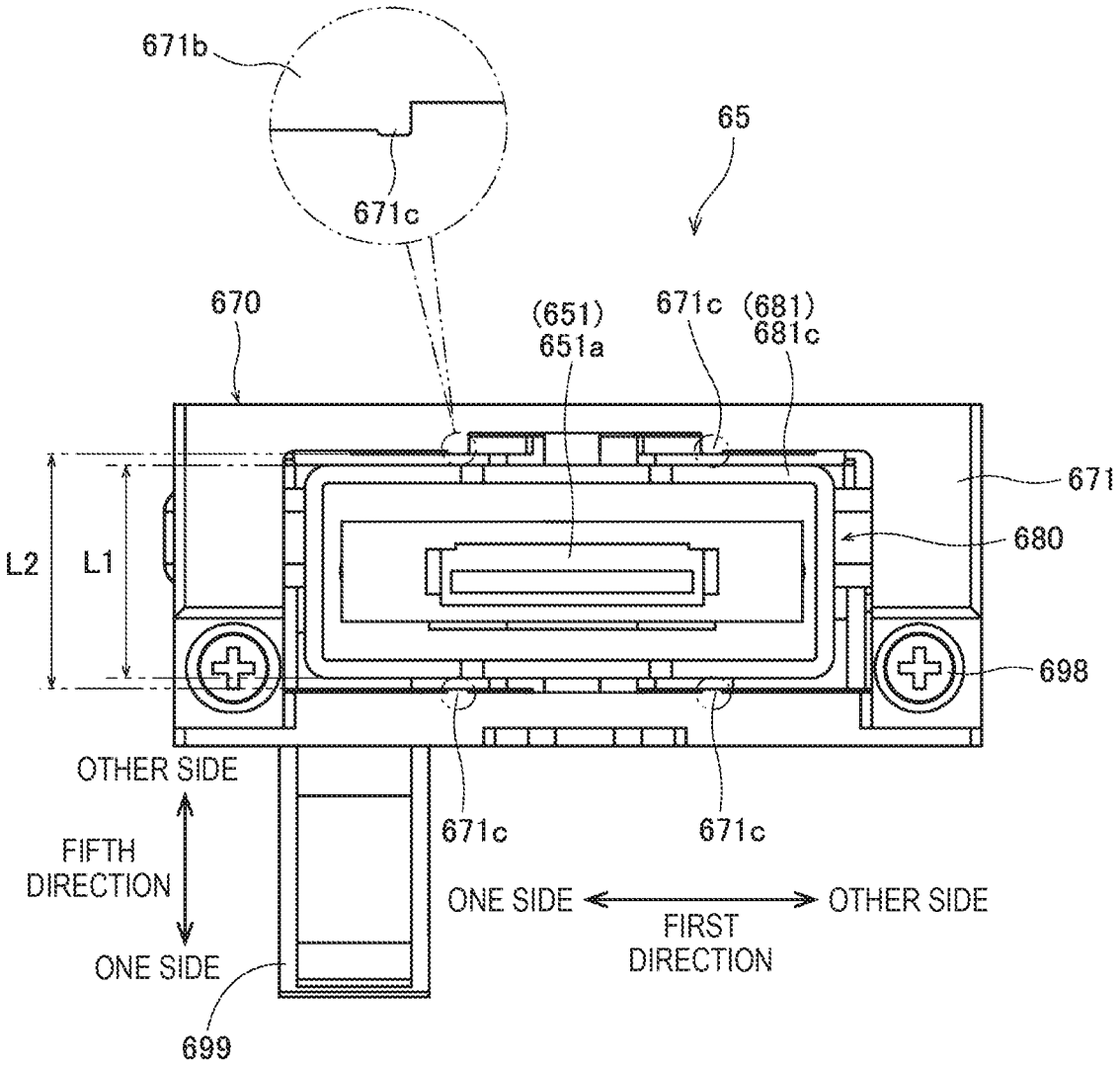
FIG. 14 depicts the main body-side connector, as seen from the other side in a fourth direction.
Figure 15:
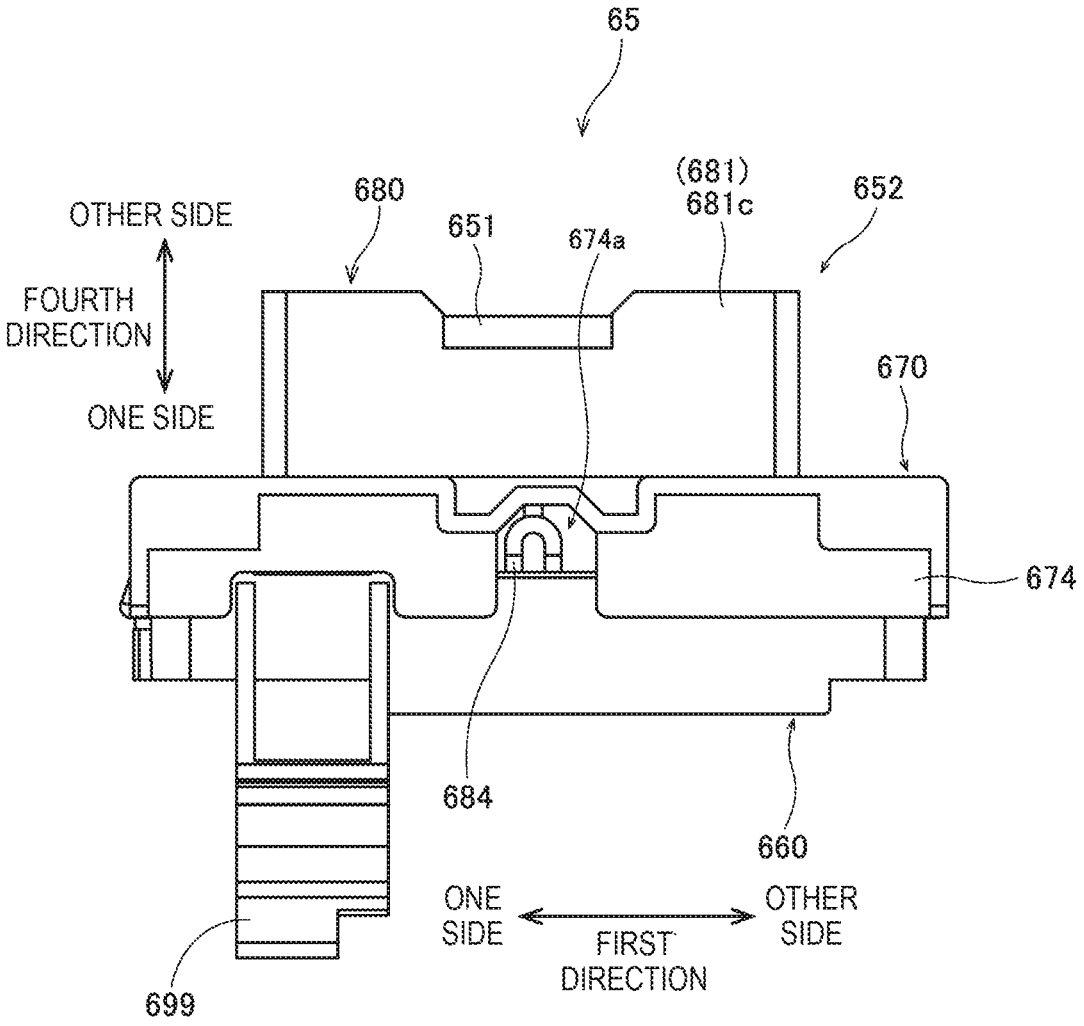
FIG. 15 depicts the main body-side connector, as seen from one side in a fifth direction.
Figure 16:
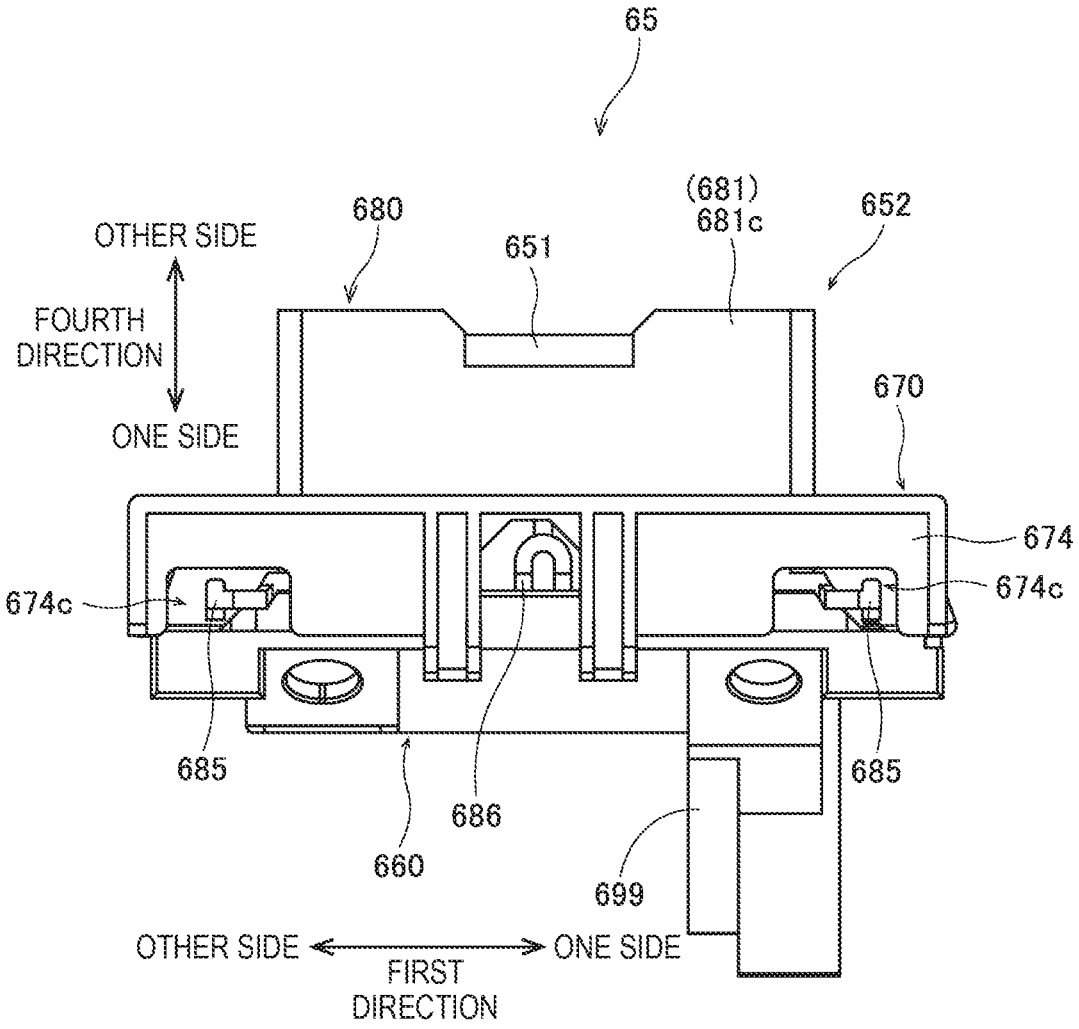
FIG. 16 depicts the main body-side connector, as seen from the other side in the fifth direction.
Figure 17:
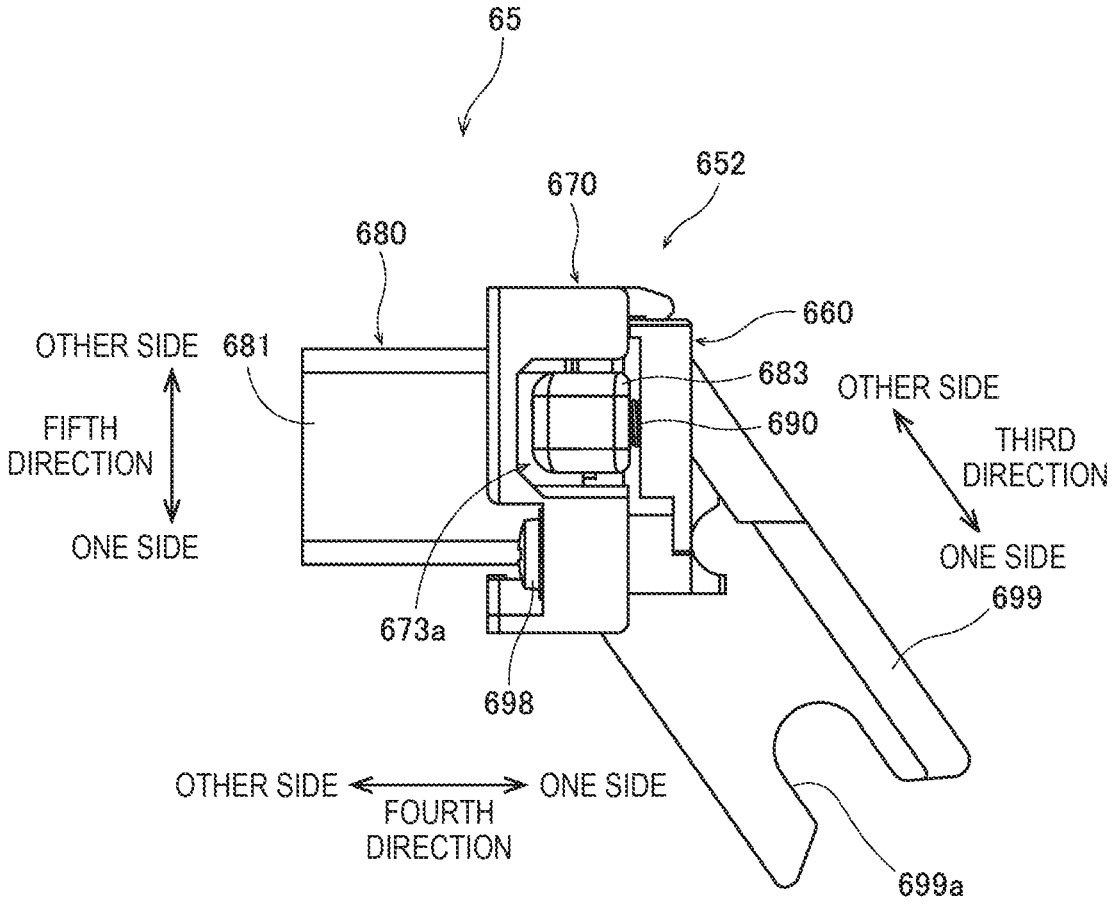
FIG. 17 depicts the main body-side connector, as seen from the other side in a first direction.
Figure 18:
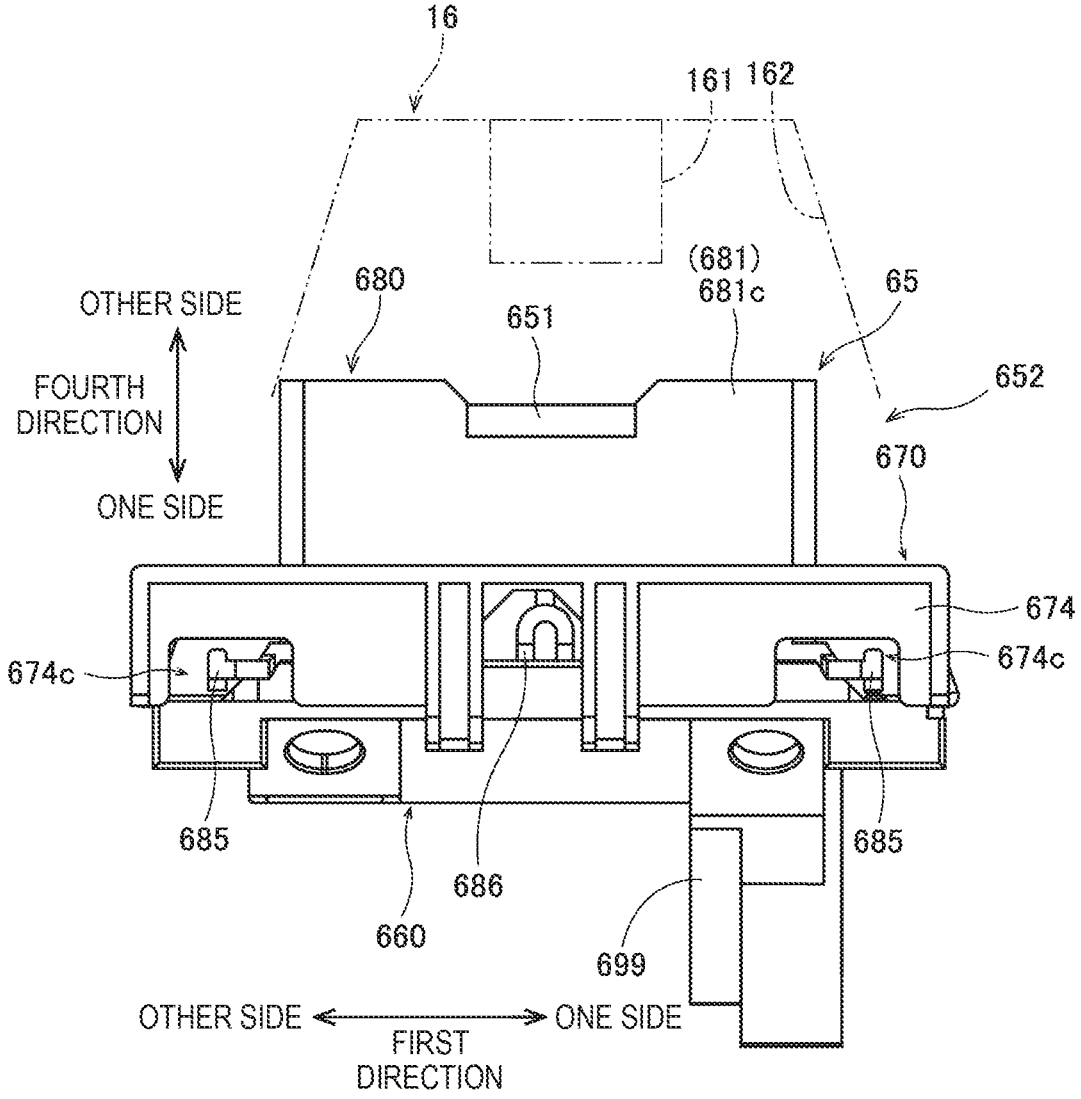
FIG. 18 is a pictorial view depicting an aspect in which the socket is in contact with a part of the holder.

In the below, movement of the main body-side connector 65 attached as described above is described with reference to FIGS. 14 to 18. FIG. 14 depicts the main body-side connector 65, as seen from the other side in the fourth direction. FIG. 15 depicts the main body-side connector 65, as seen from one side in the fifth direction. FIG. 16 depicts the main body-side connector 65, as seen from the other side in the fifth direction. FIG. 17 depicts the main body-side connector 65, as seen from the other side in the first direction. FIG. 18 depicts an aspect in which the socket 162 is in contact with a part of the holder 652.

In the main body-side connector 65, the coil springs 690 are held compressed more than a natural length between the base 660 and the panel 680. Therefore, the main body-side electrical contact part 651 is always compressed toward the other side in the fourth direction. However, the first protrusion 684 is moved only within a range surrounded by the notch 662*a* and the first notch 674*a*, and the second protrusions 685 are moved only within a range surrounded by the second notches 674*c*, so that a position of the main body-side electrical contact part 651 in the fourth direction is constant in a state in which it is not in contact with the drawer-side electrical contact part 161.

However, the coil springs 690 are held in a state in which there is an allowance for contraction toward one side in the fourth direction. For this reason, as shown in FIG. 18, when the main body-side connector 65 is applied with external force as a result of contact of the panel 680 (the box body 681) to the socket 162, for example, the coil springs 690 are deformed and the position of the main body-side electrical contact part 651 can be thus correspondingly displaceable in the fourth direction, and in the direction perpendicular to the fourth direction. That is, the main body-side electrical contact part 651 is floated with respect to a part (the base 660 and the cover 670) of the holder 652.

Also, as shown in FIG. 15, in the main body-side connector 65, a gap is formed in the first direction between an outer surface of the first protrusion 684 and an inner surface of the first notch 674*a*. Also, as shown in FIG. 16, a gap is formed in the first direction between an outer surface of the second protrusion 685 and an inner surface of the second notch 674*c*. Therefore, even when the main body-side connector 65 is applied with the external force as a result of contact of the panel 680 (the box body 681) to the socket 162, for example, the first protrusion 684 is moved only within the first notch 674*a* and the second protrusion 685 is moved only within the second notch 674*c*, so that a movement range of the main body-side electrical contact part 651 in the first direction is restrained.

Also, as shown in FIG. 14, in the main body-side connector 65, a spacing distance L2 between the protrusions 671*c* facing each other in the fifth direction is greater than a distance L1 between the outer surfaces of the sidewalls 681*c*, which face each other in the fifth direction, of the panel 680 (L1<L2). In other words, a gap is formed in the fifth direction between an outer surface of the box body 681 of the panel 680 and an inner edge surface of the protrusion 671*c*. Therefore, even when the main body-side connector 65 is applied with the external force as a result of contact of the panel 680 to the socket 162, for example, the outer surface of the sidewall 681*c* of the panel 680 is moved only to a position in which it contacts any one of the protrusions 671*c* facing in the fifth direction, so that the movement range of the main body-side electrical contact part 651 in the fifth direction is restrained.

Also, as shown in FIG. 17, the ear part 683 extends in the first direction through the third notch 673*a*. Thereby, the panel 680 is pressed by the coil springs 690 in outermore positions of the base 660 and the panel 680 in the first direction. As a result, a posture of the main body-side electrical contact part 651 is more stabilized.

Also, in the main body-side connector 65, even if the coil springs 690 are compressed by the entire allowance due to a shock upon the contact of the drawer-side electrical contact part 161 to the main body-side electrical contact part 651, for example, the first contact surface 663 of the base 660 and the second contact surface 681*f* of the box body 681 of the panel 680 are contacted to each other. In other words, the main body-side connector 65 is bottomed. In this way, the main body-side connector 65 is configured to be elastically deformable in the fourth direction, so that excessive load is prevented from being applied to the coil springs 690 and the like.

1-8. Positioning Structures of Drawer and Sheet Discharger

Figure 19:
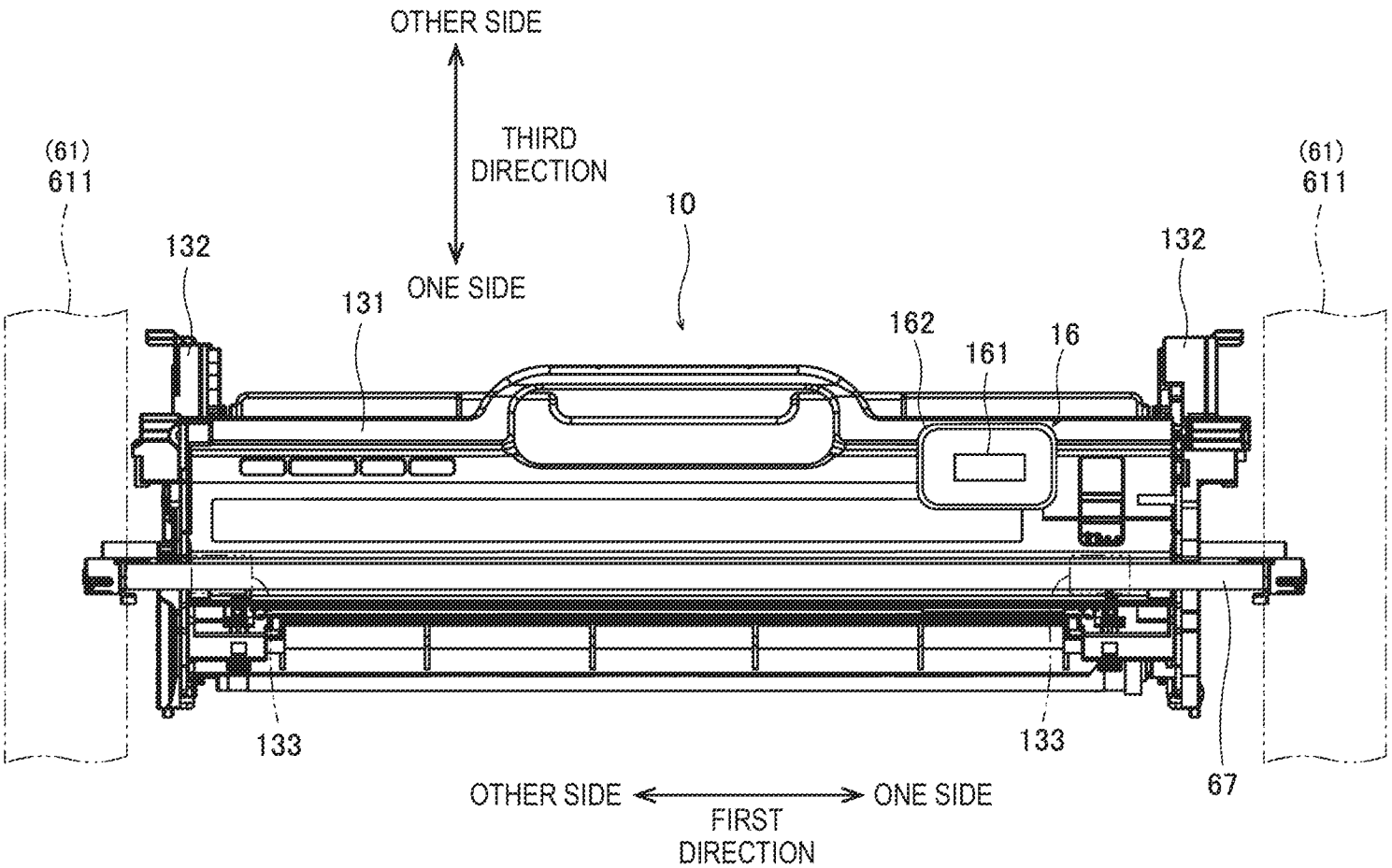
FIG. 19 depicts the drawer and the shaft, as seen from one side in the second direction.
Figure 20:
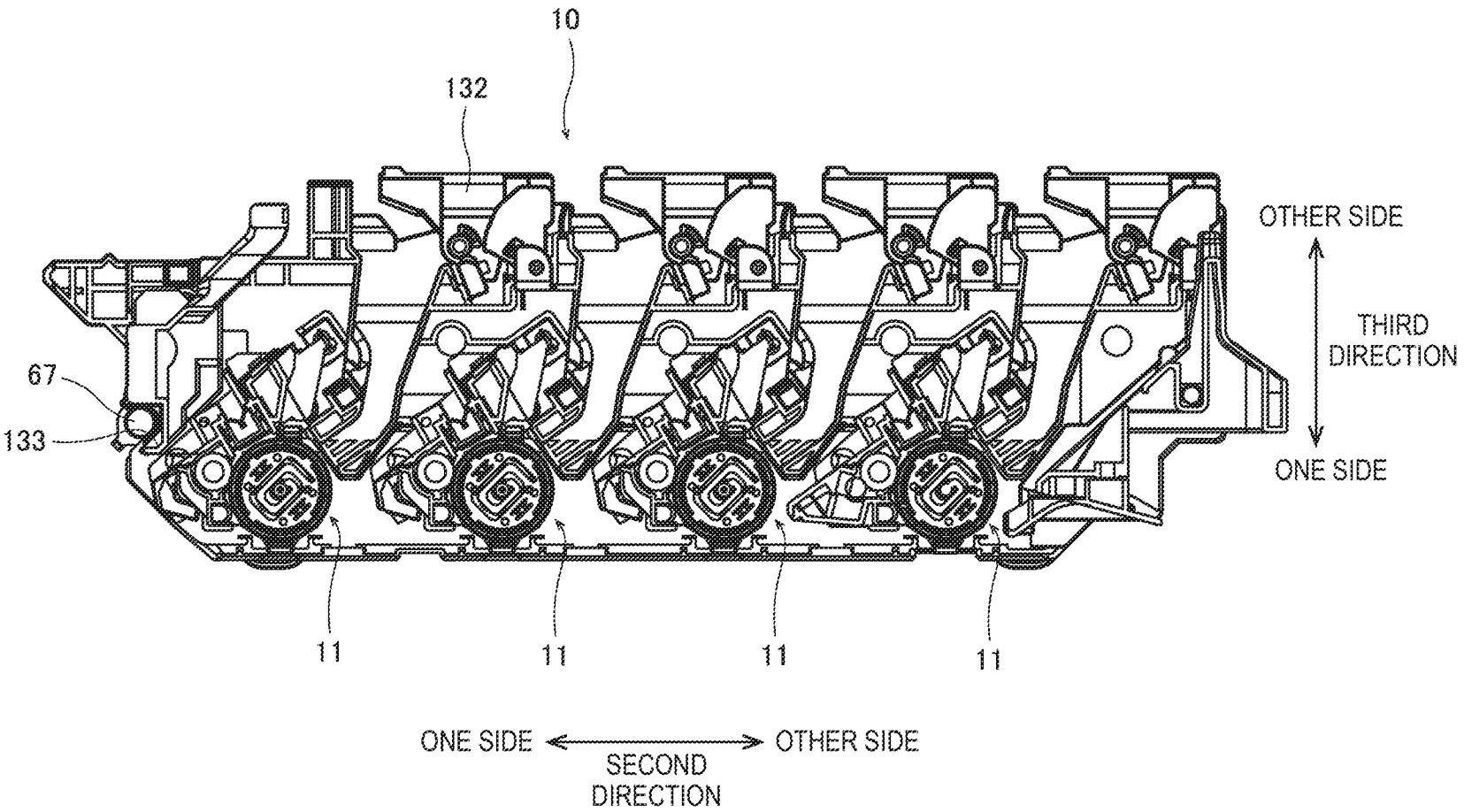
FIG. 20 is a sectional view of the drawer and the shaft taken along a plane perpendicular to the first direction.
Figure 21:
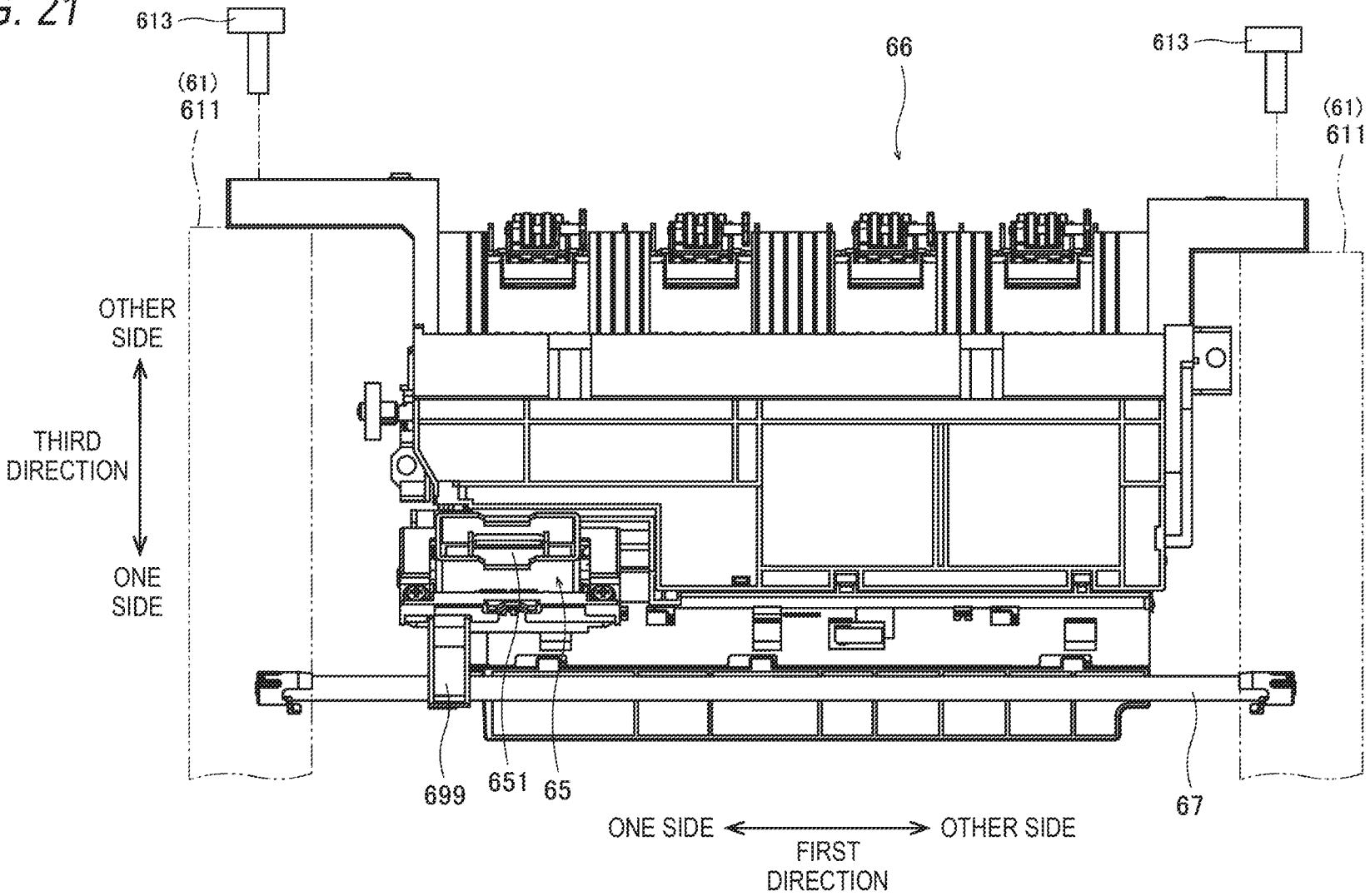
FIG. 21 depicts the unit and the shaft, as seen from the other side in the second direction.
Figure 22:
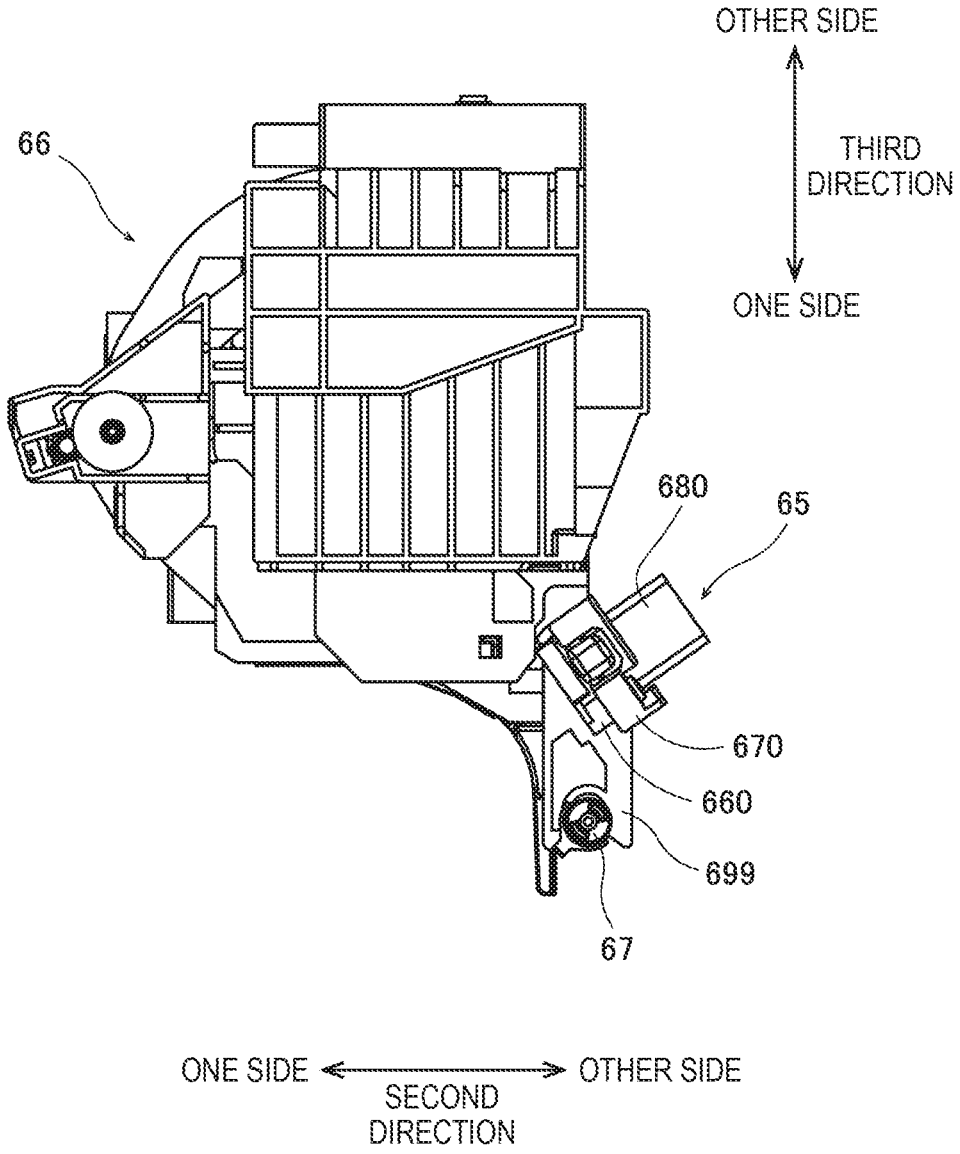
FIG. 22 depicts the unit and the shaft, as seen in the first direction.
Figure 23:
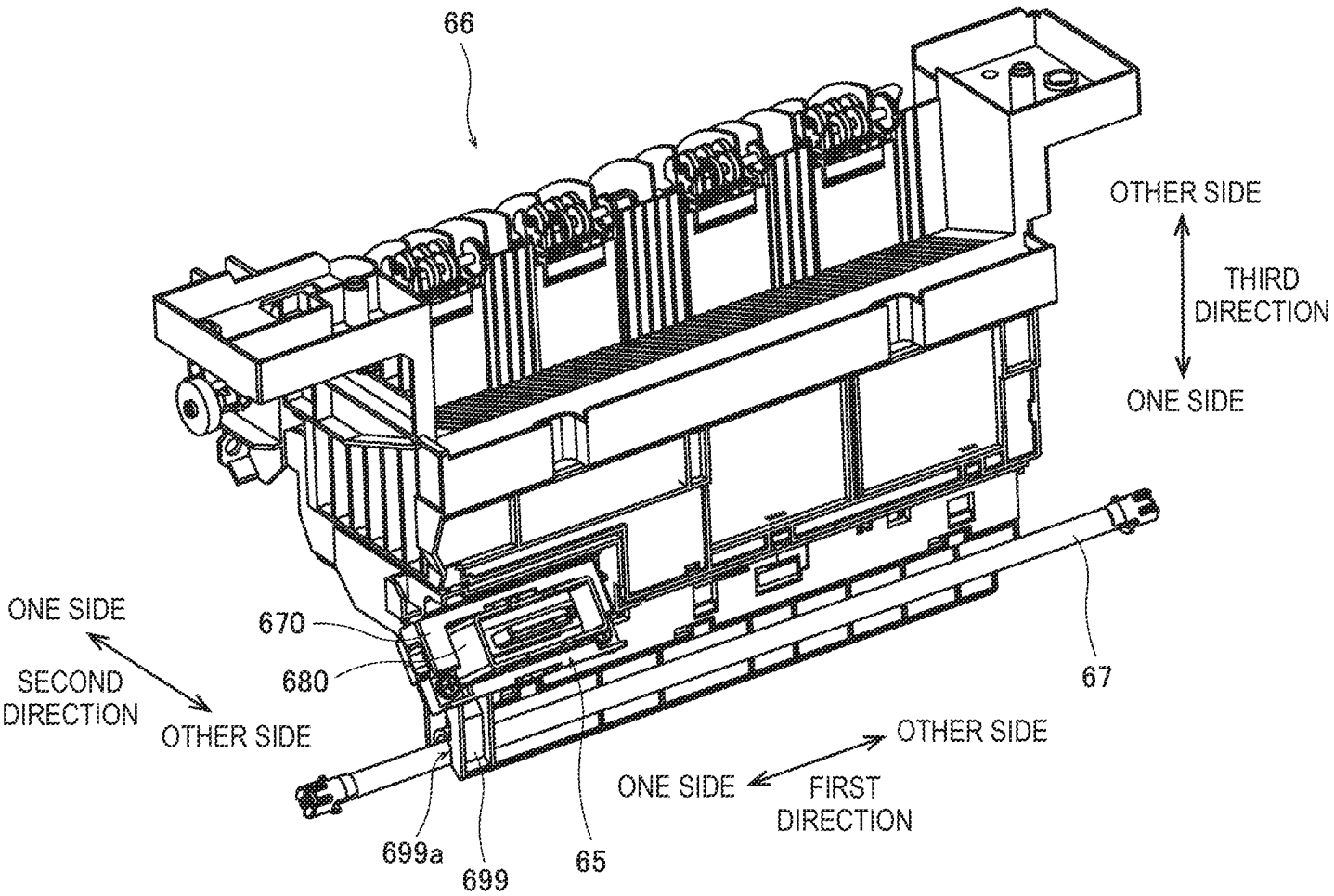
FIG. 23 is a perspective view of the unit and the shaft.

In the below, positioning structures of the drawer 10 and the sheet discharger 66 are described in detail with reference to FIGS. 19 to 23. FIG. 19 depicts the drawer 10 and the reference shaft 67, as seen from one side in the second direction. FIG. 20 is a sectional view of the drawer 10 and the reference shaft 67 taken along a plane perpendicular to the first direction. FIG. 21 depicts the sheet discharger 66 and the reference shaft 67, as seen from the other side in the second direction. FIG. 22 depicts the sheet discharger 66 and the reference shaft 67, as seen in the first direction. FIG. 23 is a perspective view of the sheet discharger 66 and the reference shaft 67.

1-8-1. Positioning Structure of Drawer

The image forming apparatus main body 60 of the image forming apparatus 100 has the reference shaft 67 and concave portions 133, as a member relating to positioning of the drawer 10.

The reference shaft 67 is arranged in the housing 61. The reference shaft 67 is a substantially circular column-shaped member extending in the first direction. The reference shaft 67 is located on one side in the fourth direction with respect to the sheet discharger 66. As shown in FIG. 19, both end portions of the reference shaft 67 in the first direction are fixed to the pair of side frames 611.

As shown in FIG. 19, the concave portions 133 are located on a downstream outer surface of the drawer 10 with respect to the insertion direction. That is, as shown in FIG. 20, the concave portion 133 is concave from an outer surface of the drawer 10 on one side in the second direction toward the other side in the second direction. The concave portions 133 are provided in a pair on both sides in the first direction while sandwiching the drawer-side connector 16 therebetween.

When the drawer 10 is inserted in the internal space 610 of the housing 61 and is thus arranged in the installation position, the reference shaft 67 is fitted in the concave portions 133 of the drawer 10. While the drawer 10 is accommodated in the internal space 610 of the housing 61 and is arranged in the installation position, the concave portions 133 press the reference shaft 67. Thereby, the drawer 10 is positioned in the installation position. In the meantime, as shown in FIG. 19, since the concave portions 133 of the drawer 10 press the reference shaft 67 on outermore sides than a central part of the reference shaft 67 in the first direction, the reference shaft 67 is difficult to be bent.

1-8-2. Positioning Structure of Sheet Discharger

The attachment part 699 of the base 660 of the image forming apparatus 100 also relates to positioning of the drawer 10 and the sheet discharger 66. That is, the attachment part 699 is an illustrative embodiment of "the connection member".

The sheet discharger 66 is positioned between the pair of side frames 611 in the internal space 610 of the housing 61. The sheet discharger 66 is positioned at one end portion of the housing 61 in the second direction.

As shown in FIG. 21, one end (an end portion on the other side in the third direction) of the sheet discharger 66 in the third direction is fastened to the housing 61 by using fastening members 613 such as bolts and the like. Also, the base 660 of the main body-side connector 65 is fixed to the sheet discharger 66. As a result, the attachment part 699 is arranged at the other end portion (an end portion on one side in the third direction) of the sheet discharger 66 in the third direction. The attachment part 699 is provided along a wall part of the sheet discharger 66 on the other side in the second direction. The attachment part 699 is arranged with being offset toward one side in the first direction with respect to a central position of the sheet discharger 66 in the first direction.

As shown in FIGS. 21 and 22, the attachment part 699 extends in the third direction. The attachment part 699 has a notch 699*a* opening toward one side in the third direction at an end portion on one side in the third direction. The notch 699*a* is formed to penetrate the attachment part 699 in the first direction. The notch 699*a* is attached to the reference shaft 67 from the other side in the third direction. Thereby, the reference shaft 67 is inserted in the notch 699*a* of the attachment part 699. As a result, the sheet discharger 66 and the reference shaft 67 are connected therebetween by the attachment part 699. As described above, the attachment part 699 is provided at a part of the main body-side connector 65. In other words, the main body-side connector 65 is supported to the attachment part 699. Thereby, the main body-side connector 65 is supported to a lower end of the sheet discharger 66. As a result, the lower end of the sheet discharger 66 is supported to the reference shaft 67 via the attachment part 699.

In this way, since the sheet discharger 66 of the illustrative embodiment is supported not only at one end in the third direction but also at the other end in the third direction, the sheet discharger 66 is positioned with accuracy. Also, the drawer-side connector 16 is connected to the main body-side connector 65 attached to the sheet discharger 66 positioned with accuracy, so that the positioning accuracy of the electrical contact part 161 of the drawer 10 is also improved.

From a different standpoint, the main body-side connector 65 is supported to the reference shaft 67 via the attachment part 699. Also, the drawer-side connector 16 is supported to the reference shaft 67. In this way, since the main body-side connector 65 and the drawer-side connector 16 are supported to the common reference shaft 67, the positioning accuracy of the main body-side electrical contact part 651 and the drawer-side electrical contact part 161 is improved.

As described above, the image forming apparatus 100 disclosed in the present disclosure includes the drawer 10, and the image forming apparatus main body 60. The drawer 10 includes the photosensitive drums 11, the frame 12, the drum memory 13 (drawer memory) and the toner memories (drawer memory) 15, and the drawer-side connector 16. The image forming apparatus main body 60 includes the housing 61, the controller 64, the main body-side connector 65, the reference shaft (shaft) 67, the sheet discharger (the unit) 66, and the attachment part (connection member) 699. When the drawer 10 is accommodated in the internal space 610, the outer surface (concave portion 133) of the drawer 10 on the downstream side in the insertion direction presses the reference shaft 67. The sheet discharger 66 is fitted at one end in the third direction to the housing 61, and is supported at the other end in the third direction to the reference shaft 67 via the attachment part 699. The main body-side connector 65 is supported to the sheet discharger the unit 66. The drawer-side electrical contact part 161 and the main body-side electrical contact part 651 are interconnected when the drawer 10 is accommodated in the internal space 610. Thereby, the outer surface (concave portion 133) of the drawer 10 on the downstream side in the insertion direction presses the reference shaft 67, so that the drawer 10 is positioned. Also, the sheet discharger 66 is difficult to be bent with respect to engaging load when the drawer 10 presses the reference shaft 67. Also, the sheet discharger 66 is stably supported at one end and at the other end in the third direction. Therefore, the reference shaft 67 itself is also difficult to be bent. As a result, it is possible to improve the positioning accuracy of the electrical contact part 161 of the drawer 10 and the electrical contact part 161 of the image forming apparatus main body 60.

Also, in the image forming apparatus 100 disclosed in the present disclosure, the main body-side connector 65 is supported to the attachment part 699. Thereby, the unit 66 and the reference shaft 67 are difficult to be bent, so that the attachment part 699 itself is also difficult to be deformed. Since the main body-side connector 65 is supported to the attachment part 699, the positioning accuracy of the main body-side connector 65 is improved. As a result, the positioning accuracy of the drawer 10 is also improved.

Also, in the image forming apparatus 100 disclosed in the present disclosure, the outer surface of the drawer 10 on the downstream side in the insertion direction has the concave portions 133 in which the reference shaft 67 is fitted. Thereby, it is possible to easily position the drawer 10 with respect to the reference shaft 67.

Also, in the image forming apparatus 100 disclosed in the present disclosure, the concave portions 133 are provided in a pair on both sides in the first direction with the drawer-side connector 16 being interposed therebetween. Thereby, since the concave portions 133 are arranged in outermore positions of the drawer 10 in the first direction, the reference shaft 67 is more difficult to be bent with respect to the engaging load when the drawer 10 presses the reference shaft 67.

Also, in the image forming apparatus 100 disclosed in the present disclosure, the attachment part 699 is arranged with being offset with respect to a central position of the reference shaft 67 in the first direction. Thereby, the unit 66 is more difficult to be bent with respect to the engaging load when the drawer 10 presses the reference shaft 67.

Also, in the image forming apparatus 100 disclosed in the present disclosure, the unit 66 is the sheet discharger 66 configured to convey the print sheet having an image formed on the recording surface. Thereby, it is possible to improve the positioning accuracy of the drawer 10 by using the sheet discharger 66.

Also, in the image forming apparatus 100 disclosed in the present disclosure, the attachment part 699 extends in the third direction intersecting with the first direction and the second direction. The attachment part 699 has the notch 699*a*, which is opened at one side close to the photosensitive drum 11 in the third direction, at one end portion on the corresponding side. Thereby, the sheet discharger 66 in which the attachment part 699 and the main body-side connector 65 are integrated is inserted between the pair of side frames 611 from the other part in the third direction and the reference shaft 67 is fitted in the notch 699*a*, so that the other part of the sheet discharger 66 in the third direction can be easily fitted to the side frames 611. In other words, the sheet discharger 66 can be easily attached to the housing 61. Also, the reference shaft 67 is fitted in the notch 699*a*, so that movement of the attachment part 699 (main body-side connector 65) in the second direction is restrained. As a result, the positioning accuracy of the main body-side connector 65 is improved.

2. Modification to Illustrative Embodiments

In the above-described illustrative embodiment, the developing cartridges 14 of respective colors are inserted to the drawer 10 as the common drum cartridge. Alternatively, the drum cartridge and the developing cartridge form a pair, and the pair of cartridges of each color (process cartridge) may be individually inserted to the drawer.

In the above-described illustrative embodiment, the main body-side electrical contact part 651 of the main body-side connector 65 has the female connector terminal. Alternatively, the main body-side electrical contact part may have a male connector terminal. In this case, the drawer-side connector may have a female connector terminal.

In the above-described illustrative embodiment, the plurality of electrical contact surfaces is aligned at the drawer-side electrical contact part 161, and the plurality of corresponding electric contact points is aligned on the main body-side electrical contact part 651. However, the present disclosure is not limited thereto. For example, the plurality of electrical contact surfaces may be aligned on the main body-side electrical contact part 651, and the plurality of corresponding electric contact points may be aligned on the drawer-side electrical contact part 161.

In the above-described illustrative embodiment, the holder 652 of the main body-side connector 65 is configured to hold the electrical contact part 651 to be floatable in the fourth direction and in the direction perpendicular to the fourth direction. In addition or alternatively, the holder of the drawer-side connector may be configured to hold the electrical contact part of the drawer-side connector to be floatable in the fourth direction and in the direction perpendicular to the fourth direction.

In the above-described illustrative embodiment, the holder 652 of the main body-side connector 65 has the coil spring 290 as the elastic member. However, the present disclosure is not limited thereto. For example, the holder of the main body-side connector may have, as the elastic member, a plate spring, a sponge, a rubber material or the like may.

In the above-described illustrative embodiment, the attachment part 699 is provided to the base 660 of the main body-side connector 65. Alternatively, the connection member may be provided separately from the member configuring the main body-side connector 65.

In the above-described illustrative embodiment, the attachment part 699 has the notch 699*a* in which the reference shaft 67 is to be fitted. Alternatively, the connection member may have a through-hole in which the reference shaft 67 is to be fitted.

In the above-described illustrative embodiment, the main body-side connector 65 is connected to the sheet discharger 66. However, the present disclosure is not limited thereto. For example, the main body-side connector 65 may be connected to a structure (unit) other than the sheet discharger 66.

In the illustrative embodiment, the image forming apparatus 100 includes, as the drawer memory, the drum memory 13 and the toner memory 15. However, the present disclosure is not limited thereto. For example, the drawer memory may have only the toner memory or only the drum memory.

Also, the configuration and detailed shape of the image forming apparatus can be appropriately changed without departing from the gist of the present disclosure. Also, the respective elements disclosed in the illustrative embodiment and the modified illustrative embodiments can be appropriately combined with no inconsistency.

As discussed above, the disclosure may provide at least the following illustrative, non-limiting aspects.

(1) An image forming apparatus comprising: a drawer comprising: a frame configured to hold a plurality of photosensitive drums while spacing the plurality of photosensitive drums at intervals in a second direction, each of the plurality of photosensitive drums being rotatable about an axis extending in a first direction; a drawer memory storing at least one of information about at least one of the plurality of photosensitive drums and information about developing cartridges removably insertable to the frame; and a drawer-side connector located at an outer surface of the frame on one side in the second direction, the drawer-side connector comprising a drawer-side electrical contact part electrically connected to the drawer memory; and an image forming apparatus main body comprising: a housing comprising: a pair of side frames facing each other in the first direction; and an internal space provided between the pair of side frames, the drawer being accommodated in the internal space by moving the drawer relative to the housing in the second direction; a controller; a main body-side connector electrically connectable to the controller, the main body-side connector comprising a main body-side electrical contact part contactable the drawer-side electrical contact part; a shaft extending in the first direction; a unit positioned between the pair of side frames, the unit being removably insertable to the housing at one end portion of the housing in the second direction; and a connection member configured to interconnect the unit and the shaft, wherein one outer surface of the drawer in the second direction is configured to press the shaft in a case the drawer is accommodated in the internal space, wherein the unit is fitted at one end in a third direction to the housing, the unit being supported at the other end in the third direction to the shaft via the connection member, the third direction intersecting with the first direction and the second direction, wherein the main body-side connector is supported to the unit, and wherein the drawer-side electrical contact part and the main body-side electrical contact part are interconnected in the case the drawer is accommodated in the internal space.

(2) The image forming apparatus of (1), wherein both end portions of the shaft in the first direction are fixed to the pair of side frames.

(3) The image forming apparatus of (1) or (2), wherein the main body-side connector is supported to the connection member.

(4) The image forming apparatus of any one of (1) to (3), wherein an outer surface of the drawer on one side in the second direction has a concave portion, the shaft being fittable in the concave portion.

(5) The image forming apparatus of (4), wherein the concave portion is provided in a pair on both sides in the first direction with interposing the drawer-side connector therebetween.

(6) The image forming apparatus of any one of (1) to (5), wherein the connection member is arranged with being offset with respect to a central position of the shaft in the first direction.

(7) The image forming apparatus of any one of (1) to (6), wherein the unit is a sheet discharger configured to convey a print sheet having an image formed on a recording sheet.

(8) The image forming apparatus of (7), wherein the connection member extends in the third direction, and wherein the connection member has a notch at one end portion thereof close to the photosensitive drum in the third direction, the notch being opened at a side of said one end portion.

(9) The image forming apparatus of any one of (1) to (8), wherein one of the drawer-side connector and the main body-side connector comprises a holder configured to hold the electrical contact part of the other of the drawer-side connector and the main body-side connector to be movable in a fourth direction, the fourth direction intersecting with both the first direction and the second direction.

(10) The image forming apparatus of (9), wherein said one of the drawer-side connector and the main body-side connector is configured to move the electrical contact part thereof in a direction perpendicular to the fourth direction by the holder, together with a part of the holder.

(11) The image forming apparatus of any one of (1) to (10), wherein the developing cartridges for accommodating toners therein are removably insertable to the frame, wherein toner identification information identifying the developing cartridges and toner life-span information are stored in the drawer memory, and wherein the drawer-side connector and the main body-side connector are interconnected to relay communication between the drawer memory and the main body controller.

(12) The image forming apparatus of any one of (1) to (11), wherein drum identification information identifying the photosensitive drums and drum life-span information are stored in the drawer memory, and wherein the drawer-side connector and the main body-side connector are interconnected to relay communication between the drawer memory and the controller.

According to the aspects (1) to (12) of the present disclosure, the image forming apparatus capable of capable of improving positioning accuracy between the electrical contact part on the drawer-side and the electrical contact part on the image forming apparatus main body-side is provided.

According to the aspects (1) to (6) of the present disclosure, the outer surface of the drawer on one side in the second direction presses the shaft, so that the drawer is positioned. Also, the drawer-side electrical contact part is connected to the main body-side electrical contact part, so that the drawer is positioned. Also, the unit configured to support the main body-side electrical contact part is stably supported at one end and at the other end in the third direction. As a result, it is possible to improve the positioning accuracy of the electrical contact part of the drawer.

According to the aspect (3) of the present disclosure, the unit and the shaft are difficult to be bent, so that the connection member itself is difficult to be deformed. Since the main body-side connector is supported to the connection member, the positioning accuracy of the main body-side connector is improved. As a result, the positioning accuracy of the drawer can also be improved.

According to the aspect (4) of the present disclosure, the drawer can be easily positioned relative to the shaft.

According to the aspect (5) of the present disclosure, since the concave portion is arranged in an outermore position of the drawer in the first direction, the shaft is more difficult to be bent with respect to the engaging load when the drawer presses the shaft.

According to the aspect (6) of the present disclosure, the unit is more difficult to be bent with respect to the engaging load when the drawer presses the shaft.

According to the aspect (7) of the present disclosure, it is possible to improve the positioning accuracy of the drawer by using the sheet discharger.

According to the aspect (8) of the present disclosure, the sheet discharger in which the connection member and the main body-side connector are integrated is inserted between the pair of side frames from the other part in the third direction and the shaft is fitted in the notch, so that the other part of the sheet discharger in the third direction can be easily fitted to the side frames. In other words, the sheet discharger can be easily attached to the housing. Also, the shaft is fitted to the notch, so that movement of the connection member (main body-side connector) in the second direction is restrained. As a result, the positioning accuracy of the main body-side connector is improved.

What is claimed is:

1. An image forming apparatus comprising:

a drum cartridge comprising:

a frame configured to hold a photosensitive drum being rotatable about an axis extending in a first direction;

a drum memory storing at least one of information about the photosensitive drum; and a drum-side connector, the drum-side connector comprising a drum-side electrical contact part electrically connected to the drum memory; and an image forming apparatus main body comprising:

a housing a controller;

a main body-side connector electrically connectable to the controller, the main body-side connector comprising a main body-side electrical contact part contactable with the drum-side electrical contact part;

a shaft extending in the first direction;

a unit being removably insertable to the housing; and a connection member configured to interconnect the unit and the shaft, wherein one outer surface of the drum cartridge is configured to press the shaft in a case the drum cartridge is accommodated in the housing, wherein the unit is fitted to the housing, the unit being supported to the shaft via the connection member, wherein the main body-side connector is supported to the unit, and wherein the drum-side electrical contact part and the main body-side electrical contact part are interconnected in the case the drum cartridge is accommodated in the housing.

2. The image forming apparatus according to claim 1, wherein the main body-side connector is supported to the connection member.

3. The image forming apparatus according to claim 1, wherein an outer surface of the drum cartridge at one side in a second direction has a concave portion, the shaft being fittable in the concave portion.

4. The image forming apparatus according to claim 3, wherein the concave portion is provided in a pair on both sides in the first direction with interposing the drum-side connector therebetween.

5. The image forming apparatus according to claim 3, wherein the first direction and the second direction intersect with each other.

6. The image forming apparatus according to claim 5, wherein the first direction and the second direction are orthogonal to each other.

7. The image forming apparatus according to claim 1, wherein the connection member is arranged with being offset with respect to a central position of the shaft in the first direction.

8. The image forming apparatus according to claim 1, wherein the unit is a sheet discharger configured to convey a print sheet having an image formed on a recording sheet.

9. The image forming apparatus according to claim 8, wherein the connection member extends in a third direction, and wherein the connection member has a notch at one end portion thereof close to the photosensitive drum in the third direction, the notch being opened at a side of said one end portion.

10. The image forming apparatus according to claim 9, wherein the third direction intersects with both the first direction and the second direction.

11. The image forming apparatus according to claim 1, wherein one of the drum-side connector and the main body-side connector comprises a holder configured to hold the electrical contact part of the other of the drum-side connector and the main body-side connector to be movable in a fourth direction, the fourth direction intersecting with both the first direction and the second direction.

12. The image forming apparatus according to claim 11, wherein said one of the drum-side connector and the main body-side connector is configured to move the electrical contact part thereof in a direction perpendicular to the fourth direction by the holder, together with a part of the holder.

13. The image forming apparatus according to claim 11, wherein the fourth direction is different from the third direction.

14. The image forming apparatus according to claim 1, further comprising:

developing cartridges for accommodating toners therein removably insertable to the frame, wherein toner identification information identifying the developing cartridges and toner life-span information are stored in the drum memory, and wherein the drum-side connector and the main body-side connector are interconnected to relay communication between the drum memory and the main body controller.

15. The image forming apparatus according to claim 1, wherein drum identification information identifying the photosensitive drums and drum life-span information are stored in the drum memory, and wherein the drum-side connector and the main body-side connector are interconnected to relay communication between the drum memory and the controller.

* * * * *